US007604705B2

(12) United States Patent
Orbey et al.

(10) Patent No.: US 7,604,705 B2
(45) Date of Patent: Oct. 20, 2009

(54) PROCESS OF SEPARATING GUN PROPELLANT COMPONENTS AND USEFUL BYPRODUCTS THEREOF

(75) Inventors: Nese Orbey, Acton, MA (US); B. Michael Cushman, Millbury, MA (US); Marina Temchenko, Swampscott, MA (US); Lev Bromberg, Swampscott, MA (US)

(73) Assignee: Foster-Miller, Inc., Waltham, MA (US)

( * ) Notice: Subject to any disclaimer, the term of this patent is extended or adjusted under 35 U.S.C. 154(b) by 147 days.

(21) Appl. No.: 10/848,557

(22) Filed: May 17, 2004

(65) Prior Publication Data

US 2009/0221747 A1 Sep. 3, 2009

(51) Int. Cl.
*F42B 33/00* (2006.01)

(52) U.S. Cl. ..... 149/109.6; 149/124; 86/50

(58) Field of Classification Search ..... None
See application file for complete search history.

(56) References Cited

U.S. PATENT DOCUMENTS 2,843,584 A * 7/1958 Buell ..... 536/38
4,038,115 A * 7/1977 Dehm ..... 149/19.8
4,098,627 A 7/1978 Tompa et al.
4,285,743 A * 8/1981 Inoue et al. ..... 149/2
4,389,265 A 6/1983 Tompa et al.
4,670,068 A * 6/1987 Chi ..... 149/19.4
4,814,439 A 3/1989 Gold et al.
4,854,982 A 8/1989 Melvin et al.
4,909,868 A 3/1990 Melvin
5,218,166 A 6/1993 Schumacher
5,284,995 A 2/1994 Melvin
5,363,603 A * 11/1994 Miller et al. ..... 451/40
5,414,198 A 5/1995 Brodman et al.
5,430,229 A 7/1995 Voss
5,977,354 A * 11/1999 Spencer et al. ..... 540/475
6,080,906 A * 6/2000 Johnson et al. ..... 435/262.5
6,080,907 A 6/2000 Miller
6,238,499 B1 5/2001 Jones et al.

* cited by examiner

*Primary Examiner*—Aileen Felton
(74) *Attorney, Agent, or Firm*—Edwards Angell Palmer & Dodge LLP; David G. Conlin; Lisa Swiszcz Hazzard

(57) ABSTRACT

Methods for the separation of targeted components from gun propellant formulations. In particular, the methods separate targeted components in a usable/useful form. Preferred methods are directed to the separation of nitrocellulose, nitroguanidine and/or nitroglycerine from a formulation containing one or more of these components.

45 Claims, 12 Drawing Sheets

| |
|---|
| FIG. 3A |
| FIG. 3B |

FIG. 3

| Feed streams | Stream | Total | NC | NG | NQ | CNT | KNO3 | Gra | H2O | Acet | DIC | Diam | CP |
|---|---|---|---|---|---|---|---|---|---|---|---|---|---|
| M30A1 Gun Propellant | 1 | 100.10 | 27.00 | 22.50 | 47.00 | 1.50 | 1.85 | 0.15 | 0.10 | | | | |
| Acetone makeup | 2 | 168.75 | | | | | | | | 168.75 | | | |
| Diisocyanate (DIC) | 3 | 13.51 | | | | | | | | | 13.51 | | |
| Diamine (optional) | 4 | 0.14 | | | | | | | | | | 0.14 | |
| Wash water | 5 | 232.34 | | | | | | | 232.34 | | | | |
| | Total In | 514.84 | 27.00 | 22.50 | 47.00 | 1.50 | 1.85 | 0.15 | 232.44 | 168.75 | 13.51 | 0.14 | 0.00 |

FIG. 3A

| Connecting streams | Stream | Total | NC | NG | NQ | CNT | KNO3 | Gra | H2O | Acet | DIC | Diam | CP |
|---|---|---|---|---|---|---|---|---|---|---|---|---|---|
| Solids to solvent extraction | 11 | 100.10 | 27.00 | 22.50 | 47.00 | 1.50 | 1.85 | 0.15 | 0.10 | 0.00 | 0.00 | 0.00 | 0.00 |
| Acetone slurry to NQ separator | 12 | 268.85 | 27.00 | 22.50 | 47.00 | 1.50 | 1.85 | 0.15 | 0.10 | 168.75 | 0.00 | 0.00 | 0.00 |
| Solvent to reactive precipitation | 13 | 207.70 | 25.44 | 21.20 | 0.53 | 1.41 | 0.05 | 0.00 | 0.09 | 158.98 | | | 0.00 |
| Slurry to NC separator | 14 | 221.21 | 0.00 | 21.20 | 0.00 | 1.41 | 0.05 | 0.00 | 0.00 | 158.98 | 3.28 | 0.00 | 36.29 |
| NQ solids from U3 separator | 15 | 61.15 | 1.56 | 1.30 | 46.47 | 0.09 | 1.80 | 0.15 | 0.01 | 9.77 | 0.00 | 0.00 | 0.00 |
| Solids from U5 separator | 16 | 44.79 | 0.00 | 0.97 | 0.00 | 0.06 | 0.05 | 0.00 | 0.00 | 7.27 | 0.15 | 0.00 | 36.29 |
| Liquids from U5 separator | 17 | 176.42 | 0.00 | 20.23 | 0.00 | 1.35 | 0.00 | 0.00 | 0.00 | 151.71 | 3.13 | 0.00 | 0.00 |
| Effluent from NQ purification | 18 | 243.14 | 1.56 | 1.30 | 0.91 | 0.09 | 1.80 | 0.00 | 227.69 | 9.77 | 0.00 | 0.00 | 0.00 |
| Effluent, CP purification* | 19 | 0.97 | 0.00 | 0.97 | 0.00 | 0.00 | 0.00 | 0.00 | 0.00 | 0.00 | 0.00 | 0.00 | 0.00 |
| Effluent, NG purification* | 20 | 0.00 | 0.00 | 0.00 | 0.00 | 0.00 | 0.00 | 0.00 | 0.00 | 0.00 | 0.00 | 0.00 | 0.00 |
| Miscellaneous emissions* | 21 | 0.00 | 0.00 | 0.00 | 0.00 | 0.00 | 0.00 | 0.00 | 0.00 | 0.00 | 0.00 | 0.00 | 0.00 |
| Recycled solvent * | 22 | 0.00 | 0.00 | 0.00 | 0.00 | 0.00 | 0.00 | 0.00 | 0.00 | 0.00 | 0.00 | 0.00 | 0.00 |
| **Products and Effluents** | **Stream** | **Total** | **NC** | **NG** | **NQ** | **CNT** | **KNO3** | **Gra** | **H2O** | **Acet** | **DIC** | **Diam** | **CP** |
| Nitroguanidine | 31 | 50.35 | 0.00 | 0.00 | 45.56 | 0.00 | 0.00 | 0.15 | 4.65 | 0.00 | 0.00 | 0.00 | 0.00 |
| Nitroglycerin liquor | 32 | 176.42 | 0.00 | 20.23 | 0.00 | 1.35 | 0.00 | 0.00 | 0.00 | 151.71 | 3.13 | 0.00 | 0.00 |
| Coating precursor | 33 | 43.96 | 0.00 | 0.00 | 0.00 | 0.06 | 0.05 | 0.00 | 0.00 | 7.27 | 0.00 | 0.02 | 36.56 |
| Wastewater | 34 | 244.11 | 1.56 | 2.27 | 0.91 | 0.09 | 1.80 | 0.00 | 227.69 | 9.77 | 0.00 | 0.00 | 0.00 |
| **Total out** | | 514.84 | 1.56 | 22.50 | 46.47 | 1.50 | 1.85 | 0.15 | 232.34 | 168.75 | 3.13 | 0.02 | 36.56 |
| **Total Out - Total In** | | **0.00** | -25.44 | 0.00 | -0.53 | 0.00 | 0.00 | 0.00 | -0.09 | 0.00 | -10.38 | -0.12 | 36.56 |

* Not fully evaluated

Gra - graphite. H2O - water. Acet - acetone DIC - diisocyanate. Diam - diamine. CP - Coating precursor.
Negative values represent amounts consumed by reaction.

FIG. 3B

PROCESS OF SEPARATING GUN PROPELLANT COMPONENTS AND USEFUL BYPRODUCTS THEREOF

STATEMENT OF GOVERNMENT INTEREST

Funding for the present invention was obtained from the Government of the United States by virtue of Contract No. W15QKN-04-C-1012 from the U.S. Department of Defense, United States Army. Thus, the Government of the United States has certain rights in and to the invention claimed herein.

FIELD OF THE INVENTION

This invention relates to a method of separating one or more targeted components from gun propellant formulations to yield useful products. More particularly, the methods are directed to the separation of nitrocellulose, nitroguanidine and/or nitroglycerine from gun propellant formulations.

BACKGROUND OF THE INVENTION

The U.S. military has stockpiled thousands of tons of surplus gun propellant materials that are now obsolete and either will not or cannot be used for future applications. It is estimated that the Department of Defense has an inventory of obsolete, excess, and off-spec munitions exceeding 400,000 tons. Reduction of this obsolete surplus is of economic and environmental necessity. However, the traditional means of open burning, open detonation or dumping are not acceptable. They yield no useable materials, contribute to pollution and increase disposal site remediation costs. In particular, these methods result in incomplete mineralization. Complete oxidation of organic materials is difficult and emissions from these methods include hydrogen chloride gas and nitrogen oxides. Further, these methods require further waste disposal. Hazardous solid wastes, that amount to over 12,000 metric tons annually, have to be contained and monitored indefinitely. Further, such methods are not economical. The basic cost of open burning/open detonation is in the region of $900/ton. To this must be added the ongoing cost of maintaining the disposal sites.

Nitrocellulose-based gun propellants and materials containing nitrate ester plasticizers have not previously been considered suitable feedstock for resource recovery and reuse technology because of their long-term instability. Consequently, demilitarization processes for nitrocellulose-based propellants have been directed at benign destruction. Processes involving acid or alkaline hydrolysis of the nitrocellulose and other components are currently being developed.

Various chemical separation methods have been proposed to separate ingredients of explosive materials. For example, U.S. Pat. No. 4,098,627 describes the solvolytic degradation of pyrotechnic materials containing crosslinked polymers. The '627 patent uses a crosslinked polymer, such as polyurethane and the like, as a component which is decomposed by heating to a temperature of up to 160° C. in a solvent comprising an active hydrogen containing compound. However, the process utilizes hazardous solvents such as ethylene diamine, benzene and the like. Further, the process yields no usable products.

Accordingly, what is needed is a cost effective, environmentally friendly and safe method for separating one or more components of gun propellant wastes. It would further be desirable to provide a method wherein the separated components are in a usable/useful form.

SUMMARY OF THE INVENTION

The present invention provides methods for the separation of one or more targeted components from gun propellant formulations. Targeted components discussed in connection with the present methods include any of the core constituents typically found in these formulations such as, for example, nitroguanidine (NQ), nitrocellulose (NC), and nitroglycerine (NG), 3,6-diamino-s-tetrazine, 3,6-bis(3,5-dimethylpyrazol-1-yl)-1,2-dihydro-1,2,4,5-tetrazine, and all other amino-s-tetrazines, hexahydro-1,3,5-trinitro-1,3,5-triazine, triethylene glycol dinitrate, 1,1,1-trimethylethane trinitrate, bis-(2,2-dinitropropyl acetal/formal, 2,4-Dinitro-2,4-diazapentane, 2,4-Dinitro-2,4-diazahexane, 3,5-Dinitro-3,5-diazaheptane and mixtures thereof. The gun propellants of the present invention can include any combination of these typical core constituents and the methods can be used to separate one or more of these core constituents. However, it is to be understood that methods of the present invention can also be used to separate other components out of such formulations.

In one embodiment, the methods of the present invention comprise recovering or breaking down one or more targeted components of gun propellant formulations by separating out the components such that the separated components are useful/usable. In preferred embodiments, nitroguanidine, nitrocellulose, and/or nitroglycerine are separated from a formulation by using solvent extraction, resin adsorption, and/or reactive extraction. In particular, the methods comprise utilizing crosslinkers and/or non-hazardous solvents to separate at least one component from the gun propellant formulation. More particularly, methods of the present invention comprise separating nitrocellulose, nitroguanidine and/or nitroglycerine from gun propellant formulations by adding crosslinkers and/or non-hazardous solvents to the gun propellant formulations to yield useful/usable forms of nitrocellulose, nitroguanidine and/or nitroglycerine.

In an exemplary embodiment, the gun propellant formulation contains nitrocellulose and, in accordance with the methods of the present invention, nitrocellulose is separated from the formulation to yield a useful/usable product of nitrocellulose. More particularly, the nitrocellulose is separated out of the formulation by adding a crosslinker to the formulation. The crosslinker can be any known crosslinker and, to effectively separate nitrocellulose from the formulation, is any crosslinker that preferentially reacts with the nitrocellulose. The nitrocellulose is preferably separated as a cross-linked nitrocellulose. In one embodiment, the cross-linker is a multifunctional isocyanate such as diisocyanates, polyisocyanates and mixtures thereof. Preferred multifunctional isocyanates are selected from aliphatic, cycloaliphatic, araliphatic, aromatic and heterocyclic polyisocyanates. Particularly preferred multifunctional isocyanate is selected from, but not limited to hexamethylediisocyanate, tetramethylxylylene diisocyanate, 4-methyl-1,3-phenylene diisocyanate, TDI and its dimers, 1,6-hexamethylene diisocyanate and its oligomers, 1-isocyanato-3-isocyanatomethyl-3,5,5-trimethyl-cyclohexane, 4,4'-diisocyanato dicyclohexylmethane and its oligomers, 1,5-diisocyanato-2-methylpentane and its oligomers, 1,12-diisocyanatododecane and its oligomers, 1,4-diisocyanatobutane and its oligomers, isophorone diisocyanate (IPDI), 1,4-cyclohexane diisocyanate, 1-methyl-2,4-cyclohexane diisocyanate, 4,4'-, 2,2'- and 2,4'-diphenylmethane diisocyanate, mixtures of 2,4- and 4,4'-diphenylmethane diisocyanate, urethane-modified, liquid 2,4- and/or 4,4'-diphenylmethane diisocyanates, 4,4'-diisocyanato-1,2-diphenylethane and 1,5-naphthylene diisocyanate, 1-methyl-2,6-cyclohexane diisocyanate and isomer mixtures thereof, 4,4'-, 2,4'- and 2,2'-dicyclohexylmethane diisocyanate and isomer mixtures thereof. A particularly preferred crosslinker for use with the present methods is 1,6-diisocyanatohexane. In some embodiments, the crosslinker is selected so as to yield a specific crosslinked nitrocellulose product.

If desired, the crosslinker may be added in the presence of a catalyst. Preferably, the catalyst is an organic or organometallic catalyst, capable of catalyzing a crosslinking reaction. Such catalysts may be selected from organic metal compounds such as titanic acid esters, iron compounds and tin compounds, which may include, for example, tin diacetate, tin dioctoate and tin dilaurate. The catalyst may also be a dialkyltin salt of aliphatic carboxylic acids such as, for example, dibutyltin diacetate, dibutyltin dilaurate or similar types of catalysts. One particularly preferred catalyst for use in the present methods is dibutyltin dilaurate.

In one exemplary embodiment, the nitrocellulose is separated from a gun propellant formulation by adding a crosslinker to the formulation, allowing the crosslinker to react with the nitrocellulose in the formulation, allowing a viscous gel to form, and drying the viscous gel to yield crosslinked nitrocellulose network. The nitrocellulose is separated from the formulation as a useful/usable product. In one embodiment, the nitrocellulose is separated as a polyurethane product. The polyurethane product may be in the form of a powder, paste, viscous or elastic solution, or gel. If desired, the nitrocellulose can be separated from the formulation as a precursor for coating compositions.

In an exemplary embodiment, the gun propellant formulation contains nitroguanidine and, in accordance with the methods of the present invention, the nitroguanidine can be separated from the formulation to yield a useful/usable product. Preferably, the nitroguanidine is separated by using a non-hazardous solvent that selectively precipitates nitroguanidine from the formulation. The solvent is selected from any conventional solvents that will not react with crosslinker(s) used in the method. Preferably, the solvent is an organic solvent. Some examples of suitable solvents include, but are not limited to, ethers, alcohols, ketones, nitriles, nitro compounds, unsubstituted or substituted aliphatic or aromatic hydrocarbons, and mixtures thereof. Particularly preferred solvents include acetone, methyl ethyl ketone, methyl isobutyl ketone, ethyl acetate, n-butyl acetate, and cyclohexanone. One particularly preferred solvent is acetone. Other typical solvents that can be used in the present methods are known to the skilled artisan and can be found in handbooks, such as Techniques of Chemistry, vol. II Organic Solvents, 3.sup.rd ed. Arnold Weissberger, Wiley-Interscience 1970. It is noted that particularly suitable solvents are those in which the crosslinked nitrocellulose formed in the process is not totally soluble.

In some embodiments, after the nitroguanidine is separated from the formulation using a non-hazardous solvent, remaining amounts of nitroguanidine remaining in the formulation are further separated. The remaining amounts of nitroguanidine can be separated, for example, by using one or more reactive resins such as aldehyde-functionalized resins. Such aldehyde-functionalized resins preferably have an active aldehyde content of not less than 1 mmol per gram. For example, StratoSpheres™ PL-CHO, StratoSpheres™ PL-ICHO and the like may be used. Preferably, the ratio of resin to nitroguanidine (CHO/NQ) is greater than or equal to 1.3. Nitroguanidine is preferably separated from the formulation as a pure product suitable for reprocessing by the military.

In some embodiments, the propellant formulation includes both nitrocellulose and nitroguanidine. As such, nitrocellulose and/or nitroguanidine can be separated from the formulation using the methods generally set forth herein. To separate both nitrocellulose and nitroguanidine, nitroguanidine is preferably separated from the formulation prior to separating the nitrocellulose out of the formulation.

In an exemplary embodiment, the gun propellant formulation contains nitroglycerine and, in accordance with the methods of the present invention, the nitroglycerine can be separated from the formulation to yield a useful/usable product. Preferably, the nitroguanidine is separated by purifying the nitroguanidine in the formulation. The nitroglycerine is preferably separated by extraction. For example, when the formulation contains both nitrocellulose and nitroguanidine, the nitroguanidine is preferably separated from the crosslinked nitrocellulose using a suitable solvent. Any solvent capable of separating nitroglycerine from the formulation may be used and can include, for example, acetone, methyl ethyl ketone, methyl isobutyl ketone, cyclohexanone, dimethylformamide, dimethylacetamide, tetrahydrofuran and mixtures thereof. The nitroglycerine is preferably separated out of the formulation in a form usable in pharmaceutical compositions or as a composition suitable as blasting industry feedstock. In some embodiments, the nitroglycerine can be separated in a form that can be safely disposed of after hydrolysis.

In some embodiments, the propellant formulation includes nitroguanidine and can further include nitroglycerine and/or nitrocellulose. As such, nitroglycerine, nitrocellulose and/or nitroguanidine can be separated from the formulation using the methods set forth herein. In particular, nitroguanidine is preferably separated from the formulation first, followed by the nitrocellulose. Nitroglycerine remaining in the formulation is then purified as set forth herein. In accordance with a preferred method, nitroguanidine, nitroglycerine and nitrocellulose are separated from gun propellant formulations by extracting nitroguanidine from the formulation using a solvent that selectively precipitates nitroguanidine from the formulation, adding a crosslinker to the formulation, allowing the crosslinker to crosslink with the nitrocellulose in the formulation and separating the crosslinked nitrocellulose from the formulation.

In another embodiment, methods of the present invention comprise separating nitroguanidine, nitrocellulose and nitroglycerine from triple-based gun propellant formulations by solubilizing the gun propellant formulation in a solution of recyclable organic solvent, separating the insoluble nitroguanidine to yield a mixture of nitrocellulose and nitroglycerine, reacting the nitrocellulose with a cross-linker to yield an insoluble nitrocellulose product and separating the nitroglycerine from the cross-linked nitrocellulose.

Methods of the present invention are capable of separating one or more targeted component (e.g. nitrocellulose, nitroglycerine, and/or nitroguanadine) from the formulation in an amount of at least about 50% of the targeted component present in the formulation, more preferably at least about 60%, more preferably at least about 70%, more preferably at least about 75%, more preferably at least about 80%, more preferably at least about 85%, more preferably at least about 90%, more preferably at least about 95%, more preferably at least about 98%, more preferably at least about 99%, and even more preferably essentially all (i.e. at least about 99.9% or 100%) of the targeted component present in the formulation.

Methods of the present invention further comprise the separation of targeted components from gun propellant formulations to yield reusable removed components. In one embodiment, the targeted components are separated by reactive extraction. In some embodiments, the targeted components are selected from energetic compounds. Preferred energetic compounds separated using the methods of the present invention are cyclic nitramines, such as hexahydro-1,3,5-trinitro-1,3,5-triazine (RDX), octahydro-1,3,5,7-tetranitro-1,3,5,7-tetrazocine (HMX), hexahydro-1-nitroso-3,5-dinitro-1,3,5-triazine (MNX) and 2,4,6,8,10,12-hexanitro-2,4,6,8,10,12-hexaazaisowurtzitane (CL-20).

Other aspects and embodiments of the invention are discussed below.

DESCRIPTION OF THE DRAWINGS

FIG. 3A and FIG. 3B show a mass balance table based on experimental results obtained in accordance with the flow sheet of FIG. 2.

DETAILED DESCRIPTION OF THE INVENTION

Figure 1:
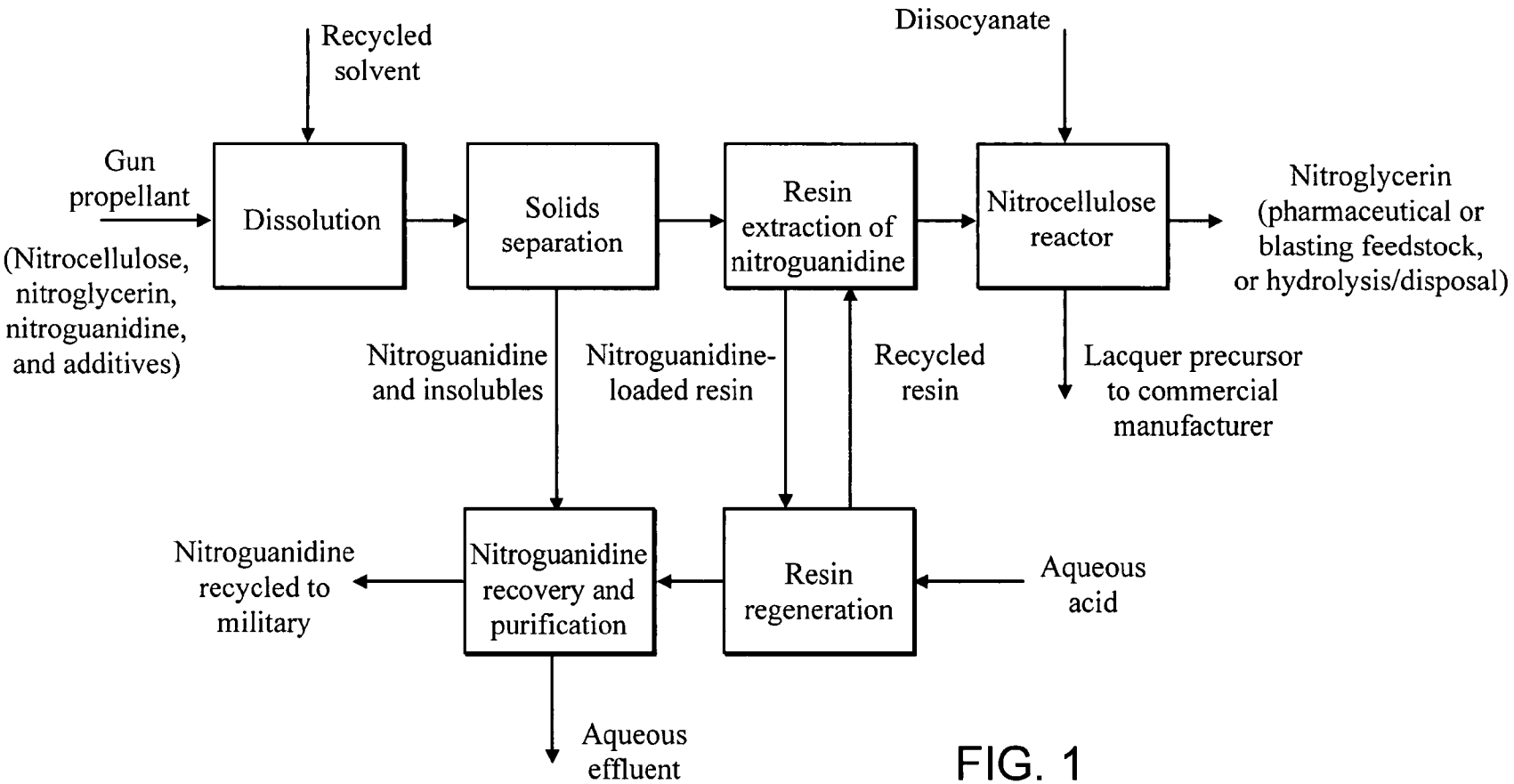
FIG. 1 shows one example of the methods of the present invention for the separation of nitrocellulose (NC), nitroglycerine (NG) and nitroguanidine (NQ) from gun propellant formulations.
Figure 2:
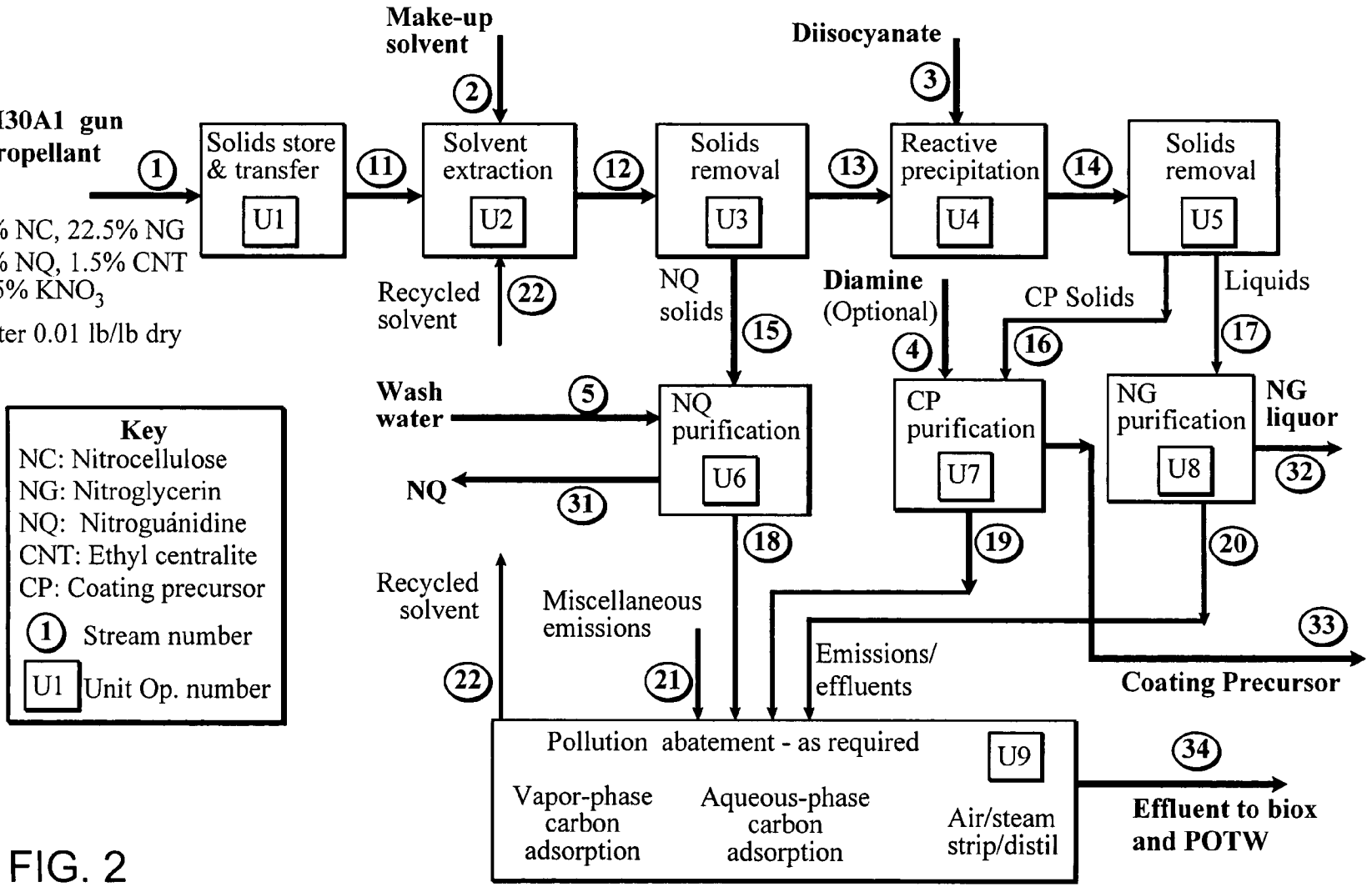
FIG. 2 shows a flow sheet for one embodiment of the present methods wherein nitrocellulose, nitroglycerine and nitroguanidine are separated out of gun propellant formulations.

The present invention provides safe, cost-effective, environmentally friendly methods for addressing the continuously mounting stockpile of surplus gun propellant materials. In particular, the present invention provides methods for separating out targeted components from gun propellant formulations in such a way that the separated components are reusable. The methods are further capable of providing high throughput for bulk processing if desired.

Typical components of gun propellant formulations include nitroguanidine, nitrocellulose and/or nitroglycerine, 3,6-diamino-s-tetrazine, hexahydro-1,3,5-trinitro-1,3,5-triazine, triethylene glycol dinitrate, 1,1,1-trimethylethane trinitrate, bis-(2,2-dinitropropyl acetal/formal, 2,4-Dinitro-2,4-diazapentane, 2,4-Dinitro-2,4-diazahexane, and the like. The methods of the present invention are directed towards separating one or more of these components from a gun propellant formulation to yield usable/useful products. For example, nitroguanidine, nitrocellulose and nitroglycerine can be separated from a propellant formulation in a form suitable for subsequent use as coatings ingredients, nutrient additives for fertilizers, latexes, binders and as pharmaceutical composition ingredients. In some embodiments, nitroguanidine is separated as a pure product suitable for reprocessing by the military. If desired, nitroglycerin can be separated in a form that is safely disposed of after hydrolysis.

In preferred methods of the present invention, the gun propellant formulations contain nitrocellulose, nitroguanidine and/or nitroglycerine and methods of the invention include the separation of one or more of these components.

The present methods for the separation of nitrocellulose from a formulation comprise the use of one or more crosslinker that preferentially reacts with the nitrocellulose. For best results, the crosslinkers should not react with other components in the formulation so as to prevent the formation of by-products. The crosslinkers are preferably multifunctional isocyanates, which are well-known to one of skill in the art. Such multifunctional isocyanates include, for example, hexamethylediisocyanate, isophorone diisocyanate, tetramethylxylylene diisocyanate, and the like, as shown below:

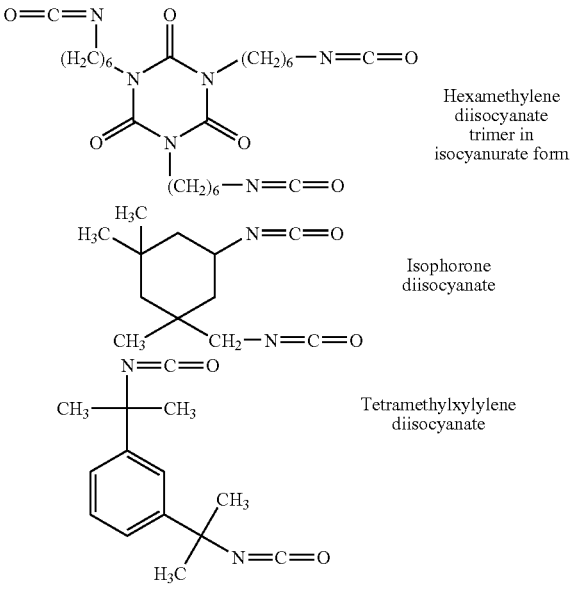

Generally, multifunctional isocyanates useful in the present methods include aliphatic, cycloaliphatic, araliphatic, aromatic and heterocyclic diisocyanates, polyisocyanates and mixtures thereof. Some exemplary isocyanates are selected from, but are not limited to hexamethylediisocyanate, isophorone diisocyanate, tetramethylxylylene diisocyanate, 4-methyl-1,3-phenylene diisocyanate, TDI, and its dimers; 1,6-hexamethylene diisocyanate and its oligomers; 1-isocyanato-3-isocyanatomethyl-3,5,5-trimethyl-cyclohexane; 4,4'-diisocyanato dicyclohexylmethane and its oligomers; 1,5-diisocyanato-2-methylpentane and its oligomers; 1,12-diisocyanatododecane and its oligomers; and 1,4-diisocyanatobutane and its oligomers. Yet other exemplary isocyanates include isophorone diisocyanate (IPDI), 1,4-cyclohexane diisocyanate, 1-methyl-2,4-cyclohexane diisocyanate, 4,4'-, 2,2'- and 2,4'-diphenylmethane diisocyanate, mixtures of 2,4- and 4,4'-diphenylmethane diisocyanate, urethane-modified, liquid 2,4- and/or 4,4'-diphenylmethane diisocyanates, 4,4'-diisocyanato-1,2-diphenylethane and 1,5-naphthylene diisocyanate, 1-methyl-2,6-cyclohexane diisocyanate and isomer mixtures thereof, 4,4'-, 2,4'- and 2,2'-dicyclohexylmethane diisocyanate and isomer mixtures thereof. In a particularly preferred embodiment, the crosslinker is 1,6-diisocyanatohexane.

Separation of the nitrocellulose by use of a crosslinker yields a cross-linked nitrocellulose. In particular, reaction of propellant formulations containing nitrocellulose with suitable crosslinkers results in the precipitation of a cross-linked nitrocellulose product. Specific crosslinked nitrocellulose products can be produced by careful selection of the crosslinker utilized. In particular, a variety of crosslinkers, such as commercially available diisocyanates, can be used to form a nitrocellulose product having properties dependent upon the diisocyanate chosen and the ratio of NCO groups to OH groups in the reaction. One of skill in the art can readily determine which type of crosslinker can be used to provide products having the desired properties. Without being bound by any theory, the ratio of NCO groups to OH groups in the reaction described above will typically result in powderous or paste-like materials with well-developed particulates. The ratio of NCO groups to OH groups in the reaction that is below will result in flowable materials easily dispersible in organic solvents such as acetone and the like. Aliphatic isocyanates such as 1,6-diisocyanatohexane, when added at the ratio of NCO groups to OH groups in the reaction that is above result in brittle, small particulates that produce pastes when dispersed in organic solvents.

The nitrocellulose product is preferably a polyurethane product in a form of powders, pastes, viscous or elastic solutions, or gels, as depicted below by a preferred cross-linking reaction of nitrocellulose with diisocyanate. Further, it may be desirable, in some applications, for the product to contain residual curable, reactive groups, such as isocyanate, amine, epoxy, alkyd, ester, acid, and the like.

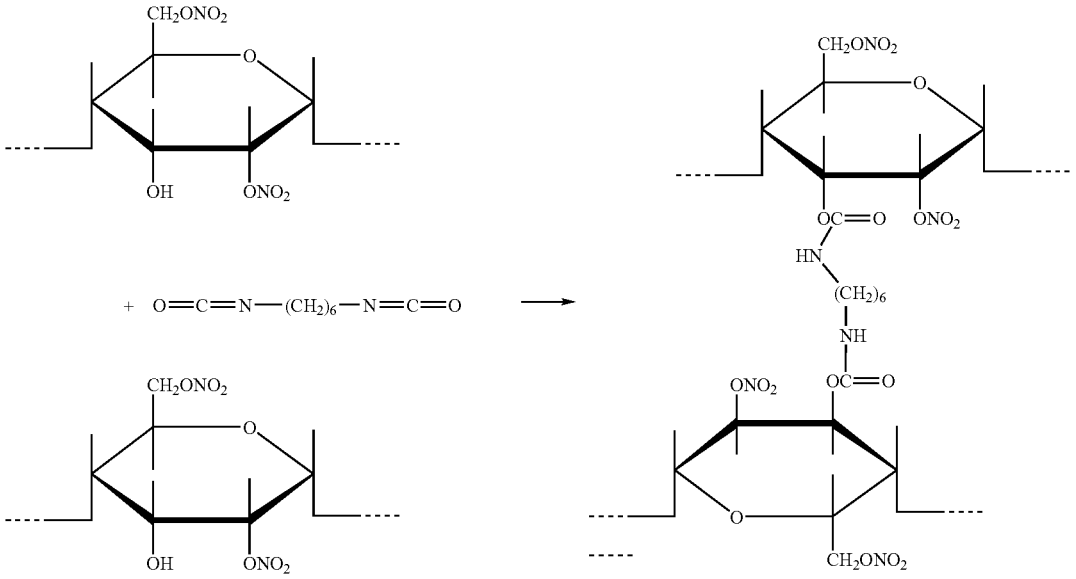

In some embodiments, the crosslinker is added in the presence of a catalyst. The catalyst is preferably an organic or organometallic catalyst, capable of catalyzing a crosslinking reaction. Some suitable catalysts include conventional organic metal compounds, such as titanic acid esters, iron compounds and tin compounds. Specific examples of such organic metal compounds are well known and include, for example, tin diacetate, tin dioctoate and tin dilaurate. The catalyst can also be a dialkyltin salt of aliphatic carboxylic acids, such as dibutyltin diacetate, dibutyltin dilaurate or the like. One particularly preferred catalyst is dibutyltin dilaurate.

In an exemplary embodiment, nitrocellulose is separated from a gun propellant formulation by adding a crosslinker to the formulation, optionally adding a catalyst, allowing the crosslinker to crosslink with the nitrocellulose in the formulation, allowing a viscous gel to form, and drying the viscous gel to yield cross-linked nitrocellulose network. According to the present methods, the nitrocellulose is separated from the formulation in a form that is useful/usable. In one embodiment, the nitrocellulose is removed as a polyurethane product. The polyurethane product may be in the form of a powder, paste, viscous or elastic solution, or gel. If desired, the nitrocellulose can be separated from the formulation as a precursor for coating compositions.

The present methods for the separation of nitroguanidine from a formulation comprise the use of one or more solvents that selectively separate nitroguanidine from the formulation. In addition to separation of the nitroguanidine, the use of a solvent provides a means of wetting the propellant formulation, thereby rendering the formulation safer to work with.

Any solvents capable of selectively separating nitroguanidine from the formulation can be used. Preferably the solvents are non-hazardous and do not react with other components in the formulation. For example, customary organic solvents, such as ethers, alcohols, ketones, nitrites, nitro compounds, unsubstituted or substituted aliphatic or aromatic hydrocarbons, and mixtures thereof may be used. Some exemplary solvents useful in the practice of the present invention include, but are not limited to acetone, methyl ethyl ketone, methyl isobutyl ketone, ethyl acetate, n-butyl acetate, and cyclohexanone. However, any conventional solvents known to the skilled artisan can be used. See, for example, Techniques of Chemistry, vol II Organic Solvents, 3rd ed. Arnold Weissberger, Wiley-Interscience 1970. Where the gun propellant formulation includes both nitrocellulose and nitroguanidine, and the nitrocellulose is separated from the formulation using one or more crosslinker, particularly suitable solvents are those in which the crosslinked nitrocellulose is not totally soluble. One particularly preferred solvent is acetone. However, other similar solvents in which the solubility of nitroguanidine is significantly less than that of nitrocellulose may be similarly used. In some embodiments, acetone has been shown to separate nitroguanidine from a gun propellant formulation with greater than 90% efficiency.

The methods of the present invention can further include the selective separation of remaining nitroguanidine in the formulation following separation by solvent. In particular, reactive resins can be used to separate/adsorb nitroguanidine in solution with organics and/or organic solvents. The reactive resins are preferably selected from aldehyde-functionalized resins. Particularly preferred aldehyde-functionalized resins have an active aldehyde content of not less than 1 mmol per gram. Some examples of suitable reactive resins include, but are not limited to StratoSpheres™ PL-CHO, StratoSpheres™ PL-ICHO available from Polymer Laboratories Ltd (Amherst Fields Research Park, 160 Old Farm Road, Amherst, Mass. 01002, USA). The separation of gun propellant materials, such as nitroguanidine and amines, from effluents by facile reaction with of nitroguanidine or diamines with aldehyde-functionalized resins is depicted below:

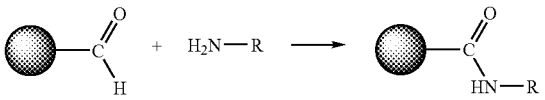

It has been found that the present methods are capable of a nitroguanidine yield of greater than 90% through acetone extraction. Due to this high yield, the resin adsorption stage is optional, and may be included based on desired recovery.

The present methods for the separation of nitroglycerine from a formulation comprises extraction of nitroglycerine using acetone and other solvents capable of nitroglycerine separation. In embodiments wherein the formulation includes nitroglycerine and nitrocellulose, after nitrocellulose is separated out of the formulation, nitroglycerine remaining in the formulation is purified by extraction using acetone and the like. The nitroglycerine is preferably separated out of the formulation in a form usable in pharmaceutical compositions and, thus, the materials used in extraction of the nitroglycerine are selected with this in mind.

Methods of the present invention can be used to separate one or more components from a gun propellant formulation. In one embodiment, methods of the present invention separate nitroguanidine and nitrocellulose from triple-base propellant formulations containing nitroguanidine, nitrocellulose and nitroglycerine. Nitroglycerine can further be separated from the formulations if desired. The methods provide particular benefits in that they provide one or more usable product from a demilitarization process. In particular, nitroguanidine is preferably separated as a pure product, while nitrocellulose is preferably separated as an intermediate or end product having commercial viability (e.g. as an ingredient in coating compositions). The ability to produce commercially-viable products, while reducing the environmental and economic burden of stockpiling obsolete munitions, has significant economic benefits.

FIG. 1 shows an exemplary process for the separation of the components from a triple-base gun propellant formulation. The formulation is first dissolved in a solvent that separates the nitroguanidine. This stage results in the formation of two streams: a solid nitroguanidine stream and a propellant solution. The solution can then be passed through a resin adsorption stage to remove any extraneous nitroguanidine remaining in the propellant solution. Upon completion of this stage, nitrocellulose from the nitroguanidine-free propellant solution is precipitated through cross-linking with a diisocyanate, leaving a solution of nitroglycerin and additives in the propellant solvent. This process yields nitroguanidine as a pure product for reprocessing by the military, cross-linked nitrocellulose as a precursor to lacquers having value to the coatings industry, and affords the ability to further process nitroglycerin for sale to the pharmaceutical or blasting industries, or, if desired, for disposal.

The methods of the present invention will be further illustrated with reference to the following Examples which are intended to aid in the understanding of the present invention, but which are not to be construed as a limitation thereof.

Example 1

Preliminary analysis of the present methods was carried out using surrogate materials. The use of surrogates permitted a more economical and safe means of assessing each stage of the process, while also presenting a means of assessing the interaction of the reagents with individual propellant constituents. Surrogate studies were performed on pure nitrocellulose and nitroguanidine, and mixtures thereof.

Nitroguanidine was obtained from Acros Chemical as a 75% water-wetted product having a molecular weight of 104 g/mol. Nitrocellulose was obtained from Aldrich Chemical as a 70% isopropanol-wetted product having a unit molecular weight of approximately 250 g/mol and having 11.8 to 12.2% nitrogen. This product was replaced in subsequent experiments by a water-wetted version distributed by Filo Chemical for Hagedorn Company, as the presence of hydroxyl groups from the alcohol will interfere with subsequent stages of the process. HPLC acetone was obtained from Aldrich Chemical.

In order to formulate a mixture of nitroguanidine and nitrocellulose, it was desirable to dry both materials. Nitroguanidine was dried through suspension of the water-wetted product in acetone. 800 mg of nitroguanidine in water was suspended in 50 mL of HPLC grade acetone. The suspension was passed through a filter, yielding 575 mg of dry nitroguanidine. Similarly, nitrocellulose was dried through removal of the isopropanol by slurrying 900 mg of the product in glass distilled and deionized water [17.3 mOhm], which yielded 600 mg of dry nitrocellulose.

One potential means of quantifying the recovery of nitroguanidine from a nitroguanidine/nitrocellulose mixture was the use of UV/Vis spectroscopy. The efficacy of this technique for the purposes of the current program was dependent upon the presence of chromophores for both nitroguanidine and nitrocellulose. As such, preliminary studies were performed on dilute solutions of these materials to obtain baseline spectra.

Nitroguanidine was prepared at 0.04M in 1M HCl and was in turn diluted 1:100 in 1M HCl, resulting in a final concentration of 0.0004M. UV/Vis spectral analysis led to $\lambda_{max}$=264 nm for nitroguanidine in HCl and a $\epsilon$=~9000, calculated according to Beers Law [A=$\epsilon$cb]. Similarly, UV/Vis spectral analysis was performed on nitroguanidine in 1M NaOH ($\lambda_{max}$32 252 nm, $\epsilon$=~9000) and acetone ($\lambda_{max}$=328, $\epsilon$=~9000). NMR analysis was run to verify the presence of nitroguanidine in acetone, which was substantiated by the presence of a peak at 207.489 corresponding to the single $sp^2$ carbon in nitroguanidine. The absence of additional carbon peaks indicated the presence of nitroguanidine as the sole material dissolved in acetone.

Nitrocellulose was prepared at 0.04M in acetone. UV/Vis spectral analysis led to $\lambda_{max}$=220 nm with $\epsilon$=20. This low epsilon value presents some difficulty in the determination of the presence of nitrocellulose.

Resin Extraction of Nitroguanidine

Resin extraction was carried out to analyze the process step for the removal of remaining nitroguanidine from the formulation. Nitroguanidine (Lot #A011274701, CAS #556-88-7, nominal water contents, 25%) was obtained from Acros Organics. The nitroguanidine was dissolved in dimethyl sulfoxide (spectrophotometric grade, 99.9%) and the residual water content was measured by Karl-Fischer titration (Mettler-Toledo DL31 Titrator). The water content was traced back to the nitroguanidine concentration and, thus, 25.0% of water content in the original nitroguanidine was determined. Reactive resins StratoSpheres™ PL-CHO (benzaldehyde, nominal loading 3.0 mmol/g) and StratoSpheres™ PL-ICHO (formyl indole, nominal loading 1.4 mmol/g) were obtained from Aldrich Chemical Co. (Milwaukee, Wis.) and used as received.

Calibration curves were generated by dissolving NQ in dimethylsulfoxide (DMSO) and measuring electronic absorbance of the resulting solutions using a Hewlett Packard Model 8452A UV-Vis Spectrophotometer and a quartz cell (path length, 1 cm). Resins samples of known weight were dispersed in corresponding nitroguanidine solutions and the resulting suspensions were gently shaken at ambient temperature overnight. The resins were removed from the samples by centrifugation (1000×g, 5 min) and the supernatant was assayed spectrophotometrically for the content of residual nitroguanidine.

Reactive Extraction of Nitrocellulose

A reactive extraction stage was analyzed as a means of recovering nitrocellulose from triple-base gun propellant formulations as a polyurethane product of commercial interest. A variety of commercially-available diisocyanates were identified and the product of their reaction with nitrocellulose evaluated.

Military grade nitrocellulose (CAS #9004-70-0, nominal nitrogen contents, 12.6%) was obtained from HAGEDORN Aktiengesellschaft (Osnabrick, Germany) in a form of water-containing flakes (nitrocellulose content, 65-75%; the rest is water). The polymer was dissolved in acetone at 20 wt % level and the solution was dried by 3 Å molecular sieves (Fluka Chemie GmbH). The residual water content in acetone solution was below 0.2 wt % as measured by Karl-Fischer titration (Mettler-Toledo DL31 Titrator). m-tetramethylxylene diisocyanate (TMXDI, CAS# 002778-42-9) was obtained from Cytec Industries, Inc. (West Paterson, N.J.), while hexamethylenediisocyanate (HMDI, 98%), isophorone diisocyanate (98%), and dibutyltin dilaurate (95%) were all obtained from Aldrich Chemical Co. (Milwaukee, Wis.) and used as received.

Polyurethanes were synthesized by adding an appropriate amount of liquid isocyanate to a 20 wt % dried solution of nitrocellulose in acetone containing 0.2 wt % of dibutyltin dilaurate. The resulting mixture was kept at 60° C. with reflux, and 0.5-mL samples were withdrawn intermittently for analysis. Depending on the isocyanate used and the nitrocellulose-isocyanate ratio, some samples rapidly solidified, as set forth in the results below. The reaction analysis and polymer characterization were performed in KBr tablets using a Perkin Elmer 1720 Fourier Transform Infrared Spectrophotometer. The spectra were taken under nitrogen atmosphere in the 400-4000 $cm^{-1}$ region. Sixty-four scans were collected with each sample with a resolution of 2 $cm^{-1}$ and signal-averaged.

Figure 4:
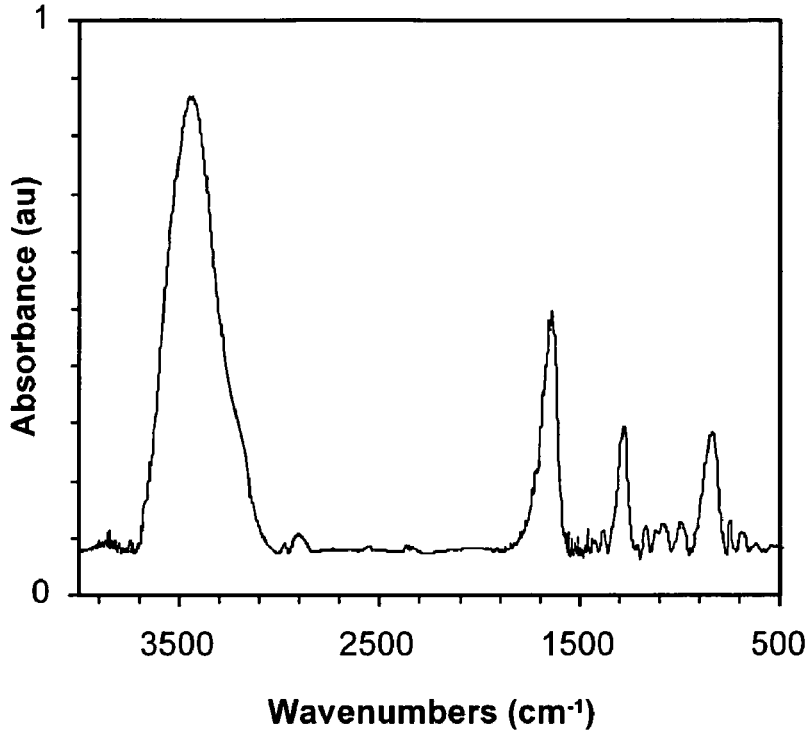
FIG. 4 shows the FTIR spectrum of as-received nitrocellulose (NC) sample in KBr.

FTIR spectrum of the original nitrocellulose sample is shown in FIG. 4 and peak assignments are collected in Table 1. Due to the large amount of water present, OH stretching in the area 3500-3300 $cm^{-1}$ is not apparent. Having the NC samples snap-frozen and lyophilized to dryness under high vacuum (1 mTorr), the relative intensity of the OH band at 3315 $cm^{-1}$ was utilized to determine band's extinction coefficient and corresponding equivalent of the OH groups per glucose unit ($\alpha$) as described in J.-J. Jutier, Y. Harrison, S. Premont, R. E. Prudhomme, *J. Appl. Polym. Sci.,* 1987, 33, 1359-1375. For the analysis, relative nitrogen content of 12.6% (provided by the manufacturer) was used. This procedure yielded $\alpha$=0.55.

TABLE 1

Assignments of FTIR bands in the NC spectrum

| Wavenumber ($cm^{-1}$) | Relative intensity | Assignment |
|---|---|---|
| 2975 | Medium | $CH_2$ asymmetric stretching |
| 2908 | Medium | CH stretching |
| 1640 | Very strong | $NO_2$ asymmetric stretching |
| 1430 | Weak | $CH_2$ bending |
| 1376 | Medium | CH bending |
| 1278 | Very strong | $NO_2$ symmetric stretching |
| 1160 | Medium | Asymmetric O stretch |
| 1076 | Medium | C—O stretch in C1-O-C4' |
| 830 | Very strong | O—$NO_2$ stretching |
| 750 | Medium | O—$NO_2$ stretching |
| 688 | Medium | O—$NO_2$ deformation |

Figure 5:
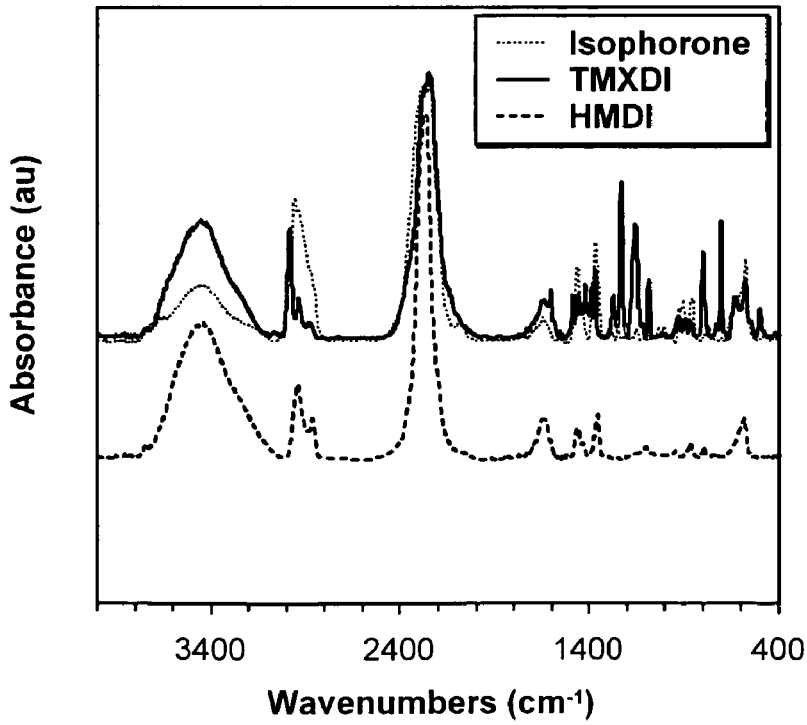
FIG. 5 shows the FTIR spectra of as-received HMDI, isophorone diisocyanate, and TMXDI samples in KBr.

FTIR spectra of as-received samples of HMDI, isophorone diisocyanate, and TMXDI are shown in FIG. 5. A strong band of the —N═C═O isocyanate group at 2300 $cm^{-1}$ dominates the spectra, with some clearly identifiable medium-intensity aromatic (TMXDI and isophorone diisocyanate) and aliphatic (HMDI) bands.

Upon addition of diisocyanates to the NC samples, changes in the appearance of the samples were quite vivid. Yellowish to light-brown reaction products ensued, resulting in viscosity changes. To set the initial effective ratio ($\beta$) of the NCOto-OH equivalents in the reaction mixtures, nominal molecular weights of the isocyanates and $\alpha$=0.55 were used. The results of the reaction depended on $\beta$ (Table 2).

TABLE 2

Results of the diisocyanate-NC reaction in acetone

| $\beta$ | HMDI Product (1 hr) | $\beta$ | Isophorone Dilsocyanate Product (1 hr) | $\beta$ | TMXDI Product (1 hr) |
|---|---|---|---|---|---|
| 0.2 | Soft gel, syneresis | 0.2 | Liquid | 0.2 | Liquid |
| 1 | Elastic gel | 1 | Viscous paste | 1 | Soft particulates, phase-separated |
| 2.5 | Brittle solid | 2.5 | Viscous paste | 2.5 | Viscous paste |

Figure 6:
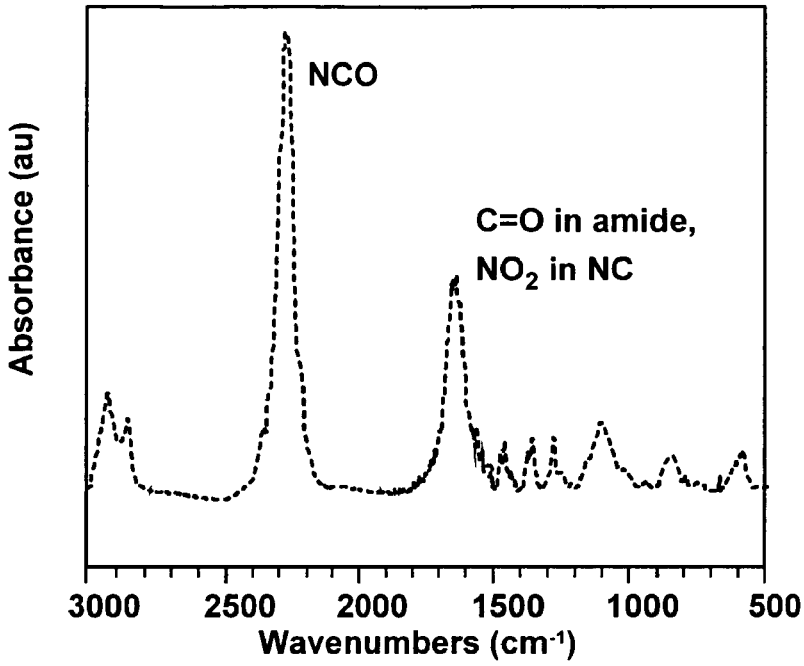
FIG. 6 shows a typical FTIR spectrum of a NC/HMDI reaction mixture (β=[NCO]/[OH]=1.0). The sample was withdrawn 5 min after the commencement of the reaction, snap-frozen in liquid nitrogen and acetone was evaporated under vacuum to constant weight.

Upon formation of the urethane bond, the intensity of the isocyanate band diminished, while a characteristic band of the C═O stretch of the amide bond appeared in the area of 1650-1630 $cm^{-1}$ (FIG. 6). Peaks belonging to the amide stretch were obscured by the very intense peak of the $NO_2$ stretch constantly present in the reaction mixture. The carbonyl stretch of the solvent (acetone) present in the reaction mixture also overlaped with the amide bands in this area of the spectra.

Figure 7:
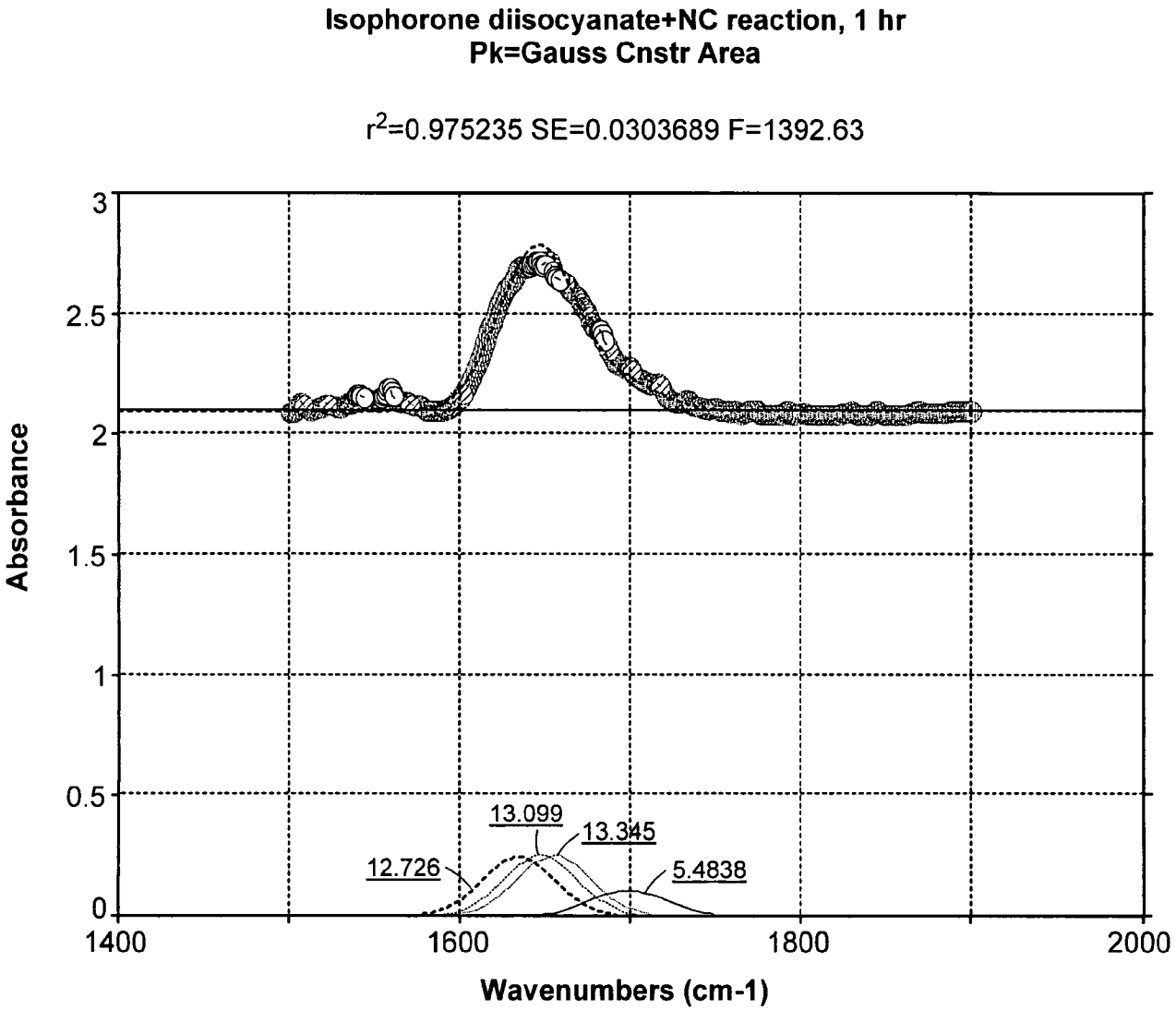
FIG. 7 shows representative FTIR peak intensity calculation. Gaussian peak area parameters in the range of wavelengths 1600-1650 cm−1 as shown were used to calculate the area of the NO2 stretch peak ($A_{NO2}$).

In order to quantify the kinetics of the formation of the polyurethane products of the NC-diisocyanate reaction, the area of the $NO_2$ stretch band ($A_{NO2}$) always present in the reaction mixture was separated from the time-depended bands. Spectra were compared by digital difference methods using SpectraCalc and GRAMS/AI Version 7 software (Thermo Galactic, Salem, N.H.) as well as using PeakFit Version 4.11 software (Systat Software Inc., Richmond, Calif.) (FIG. 7).

Figure 8:
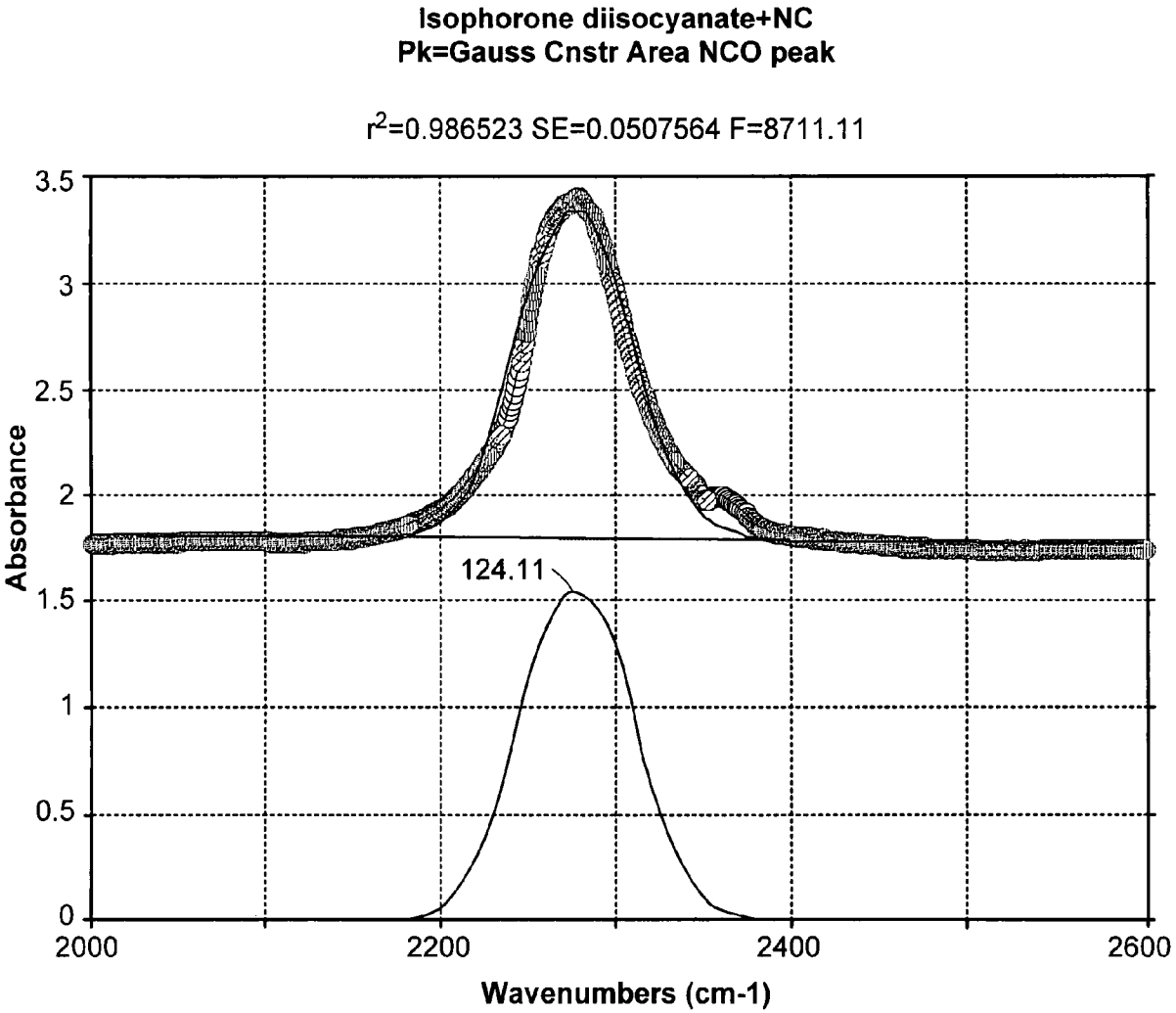
FIG. 8 shows representative FTIR peak intensity calculation. Gaussian peak area parameters in the range of wavelengths 2100-2400 cm−1 were used to calculate the area of the isocyanate stretch peak ($A_{NCO}$).

The area of the $NO_2$ band was compared to the area of the N═C═O band ($A_{NCO}$) that diminished over time as reaction proceeded (FIG. 8).

Figure 9:
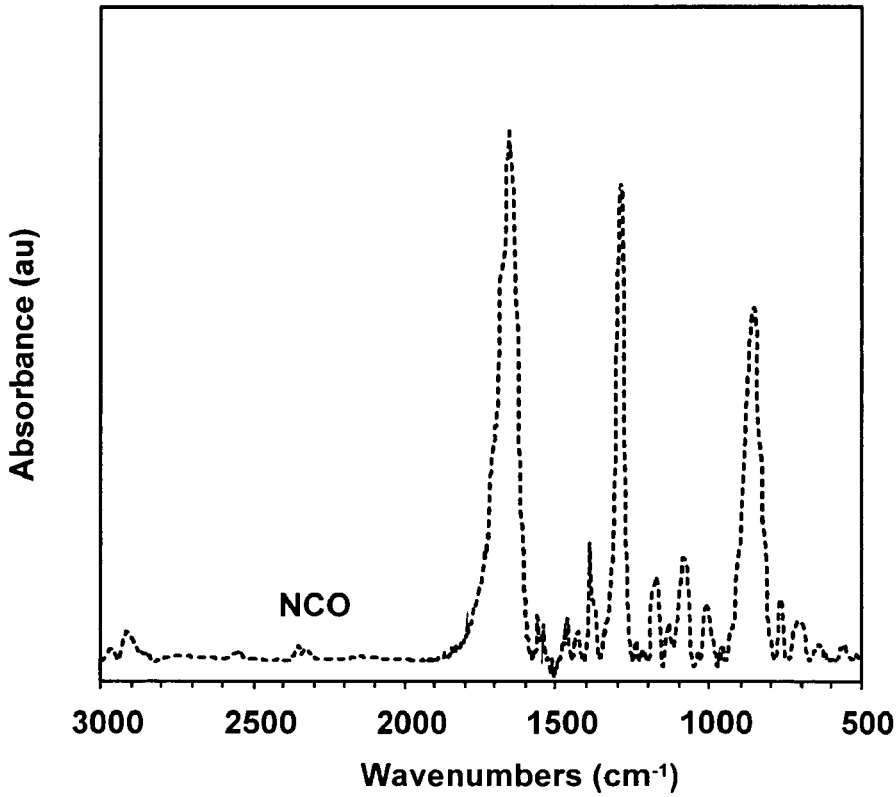
FIG. 9 shows FTIR spectrum of a NC/TMXDI reaction mixture (β=[NCO]/[OH]=0.2). The sample was withdrawn 1 h after the reaction commencement.
Figure 10:
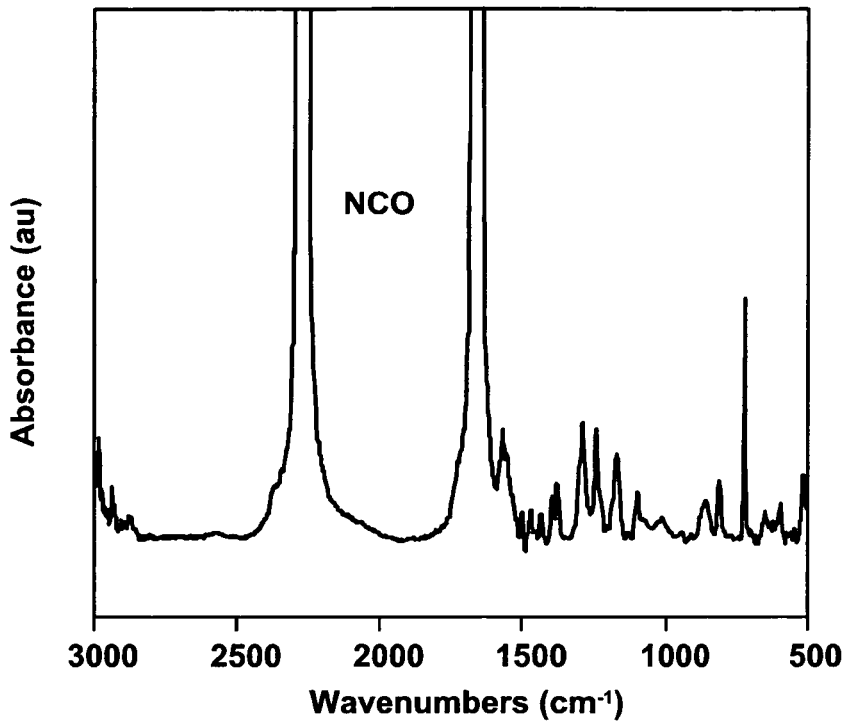
FIG. 10 shows FTIR spectrum of a NC/TMXDI reaction mixture (β=[NCO]/[OH]=2.5). The sample was kept for 1 month in a sealed vial at ambient temperature after the reaction completion.

From the peak area analysis, it was concluded from that the reactivity of the isocyanates decreased in the order HMDI>isophorone diisocyanate>TMXDI, as the reaction was complete within about 0.5 h, 1 h, and 3 h, respectively, in all corresponding samples. The completeness of the reaction was ensured by the fact that the area of the N═C═O peaks reached plateau. Furthermore, $A_{NCO}$ in the samples with $\beta$<1 became negligibly small, which manifested the completion of the reaction (FIG. 9), while the NCO band in the samples with $\beta$>1 was quite persistent and remained indefinitely in samples kept in tightly sealed vials (FIG. 10). Hence, depending on the $\beta$ set up in the reaction, the products may contain NCO capable of further reacting if required (i.e., the products of these reactions are curable). These results demonstrate the possibility of optimization of the polyurethane formation in polycondensation reactions between the military-grade nitrocellulose and diisocyanates, such that physical properties and reactivity of the products can be tailored as desired.

Example 2

Analysis was carried out on an actual triple-base propellant. M30A1 was selected as the triple-base propellant of interest. Ground propellant was obtained from a United States Army stockpile. This material is processed using the methods described in the preceding sections for each stage of the process.

Reagents for each stage of the proposed process were identified for each task. Table 3 summarizes the evaluation of candidate reagents for the proposed process.

TABLE 3

Reagent Evaluation

| Reagent | Comments |
|---|---|
| Acetone | Environmental Impact—EPA exempt solvent<br>Safety—Fire/explosion hazard<br>Economics—Abundant, cost-effective, explosion proof equipment needed, but already necessary for propellants<br>Reagent Processing—No co-solvents needed<br>By-Products—No reaction is anticipated producing new materials |
| Ethyl Acetate | Environmental Impact—Toxic<br>Safety—Fire/explosion hazard<br>Economics—Expensive solvent<br>Reagent Processing—Solubility of NQ is greater than in acetone. Will likely require subsequent solvents<br>By-Products—May react with any strong oxidizers present |
| Butyl Acetate | Environmental Impact—Toxic.<br>Safety—Fire hazard. Emissions may react to form explosive mixtures<br>Economics—Price similar to ethyl acetate<br>By-Products—May react with acids, bases to form by-products |
| Ethanol | Environmental Impact—Common solvent<br>Safety—Fire hazard<br>Economics—Readily available<br>Reagent Processing—May cause complication in reactive extraction stage. Hydroxyl groups will react with diisocyanates.<br>By-Products—Likely by-products will occur if used in the reactive extraction stage. |
| Methanol | Environmental Impact—Common solvent<br>Safety—Fire hazard<br>Economics—Readily available<br>Reagent Processing—May cause complication in reactive extraction stage. Hydroxyl groups will react with diisocyantes.<br>By-Products—Likely by-products will occur if used in reactive extraction stage. |
| Dimethylformamide | Environmental Impact—Toxic.<br>Safety—Combustible.<br>Economics—Slightly more expensive than ethyl acetate<br>Reagent Processing—Anticipated value in resin analysis.<br>NQ will be soluble to a higher degree than in acetone<br>By-Products—Reacts with strong oxidizers. Use will be dictated by pH of acid used in regeneration of resins. |
| Diphenylamine (Nitroguanidine surrogate and possible M3OA1 additive) | Environmental Impact—Toxic<br>Safety—Stable compound.<br>Reagent Processing—Similar functionality to NQ.<br>By-Products—Surrogate material |
| Glyceryl Tributyrate (Nitroglycerine surrogate) | Environmental Impact—Low toxicity<br>Safety—Stable compound<br>By-Products—Surrogate material |
| Formyl Indole Resin | Environmental Impact—Low toxicity.<br>Safety—Stable compound<br>Economics—Expensive<br>Reagent Processing—Functional groups will react with amines. Will likely require regeneration stage to cleave collected amines.<br>By-Products—By-products not anticipated. Waste may be uncleaved resin |
| Benzaldehyde Resin | Environmental Impact—Minimal toxicity<br>Safety—No severe or acute health hazard. Stable compound.<br>Economics—One-third the cost of formyl indole resin<br>Reagent Processing—Aldehyde groups will react with amines. Will likely require regeneration stage to cleave collected amines.<br>By-Products—By-products not anticipated |

TABLE 3-continued

| Reagent | Reagent Evaluation Comments |
|---|---|
| Formylphenoxy Resin | Environmental Impact—Minimal toxicity<br>Safety—Stable compound.<br>Economics—Twice the cost of formyl indole resin<br>Reagent Processing—Functional groups will react with amines. Will likely require regeneration stage to cleave collected amines.<br>By-Products—By-products not anticipated. Waste may be uncleaved resin. |
| Benzyloxybenzaldehyde Resin | Environmental Impact—Minimal toxicity<br>Safety—Stable compound.<br>Economics—One-third the cost of formyl indole resin<br>Reagent Processing—Aldehyde groups will react with amines. Will likely require regeneration stage to cleave collected amines.<br>By-Products—By-products not anticipated. Waste may be uncleaved resin. |

Acetone was found to be particularly suitable due to nitroguanadine's insolubility and nitrocellulose's and nitroglycerine's solubility. Nitroguanadine was found to be slightly soluble in ethyl acetate and, thus, subsequent solvents are recommended for use with ethyl acetate. It is believed that ethyl acetate will be helpful in producing more concentrated solutions of nitroguanading for resin analysis. It was found that butyl acetate may potentially react with acids and bases in the propellant formulation to form by-products. Thus, use of butyl acetate would likely require additional purification steps. It was found that ethanol and methanol can present some complications in the reactive extraction stage as hydroxyl groups present in ethanol and methanol will react with diisocyanates used in the process and. In particular, it is likely that by-products will occur if ethanol or methanol is used in the reactive extraction stage. Its use would likely require additional purification steps. Dimethylformamide was found to react with strong oxidizers. It is believed that its use will be dictated by the pH of acid used in regeneration of resins. Formyl indole resin and formylphenoxy resin were found to contain functional groups that will react with amines. Their use will likely require a regeneration stage to cleave collected amines. Further, any uncleaved resin may result in waste. Aldehyde groups in benzaldehyde resin and benzyloxybenzaldehyde resin will react with amines in the propellant formulation. Thus, their use will likely require a regeneration stage to cleave collected amines. Uncleaved resin may result in waste.

In addition to acetone, the solubilities of nitroguanidine and nitrocellulose in potassium hydroxide and hydrochloric acid were studied. Solubility data is presented in Table 3 for nitroguanidine and Table 4 for nitrocellulose.

TABLE 3

Solubility of nitroguanidine

| NQ (mg) | 1 M KOH (mL) | 1 M HCl (mL) | Acetone | Solubility | Recovery | Method |
|---|---|---|---|---|---|---|
| 104 | 10 | — | — | complete | 98% | UV $\lambda_{max}$ 252 |
| 104 | 25 | — | — | complete | 98% | UV $\lambda_{max}$ 252 |
| 104 | 100 | — | — | complete | 98% | UV $\lambda_{max}$ 252 |
| 104 | — | 10 | — | complete | 97% | UV $\lambda_{max}$ 264 |
| 104 | — | 25 | — | complete | 98% | UV $\lambda_{max}$ 264 |

TABLE 3-continued

Solubility of nitroguanidine

| NQ (mg) | 1 M KOH (mL) | 1 M HCl (mL) | Acetone | Solubility | Recovery | Method |
|---|---|---|---|---|---|---|
| 104 | — | 100 | — | complete | 98% | UV $\lambda_{max}$ 264 |
| 104 | — | — | 10 | insoluble | 102 mg (98.1%) | filtration |
| 104 | — | — | 25 | insoluble | 99.1 mg (95.3%) | filtration |
| 104 | — | — | 100 | slightly soluble | 84 mg (80.7%) | filtration |

TABLE 4

Solubility of nitrocellulose

| NC (mg) | 1 M KOH (mL) | 1 M HCl (mL) | Acetone | Solubility | Recovery | Method |
|---|---|---|---|---|---|---|
| 250 | 10 | — | — | decomposed | NA | — |
| 250 | 25 | — | — | decomposed | NA | — |
| 250 | 100 | — | — | decomposed | NA | — |
| 250 | — | 10 | — | insoluble | 248 mg (99.2%) | filtration |
| 250 | — | 25 | — | insoluble | 231 mg (92.4%) | filtration |
| 250 | — | 100 | — | slightly soluble | 187 mg (74.8%) | filtration |
| 250 | — | — | 10 | complete | 241 mg (96.4%) | evaporation |
| 250 | — | — | 25 | complete | 235 mg (94.3%) | evaporation |
| 250 | — | — | 100 | complete | 218 mg (87.1%) | evaporation |

This data suggests that the separation of nitroguanadine from nitrocellulose may be possible through simple extraction in acetone. To verify, a simulated propellant having a 1:1 molar ratio of nitroguanidine to nitrocellulose was produced by adding 104 mg (1 mmol) of nitroguanadine and 250 mg (1 mmol) of nitrocellulose to 25.0 mL of dry acetone and stirring overnight. Filtration of the resultant slurry yielded the data summarized in Table 5.

TABLE 5

Results of solvent extraction in acetone

| Compound | Mass (mg) | Concentration (mM) | Post Filtration In Solution | Post Filtration In Filtrate |
|---|---|---|---|---|
| Nitrocellulose | 250 | 40 | 39 mM (97.50%) [UV $\lambda_{max}$ 210] | ND |
| Nitroguanidine | 104 | 40 | 3 mM (7.50%) [UV $\lambda_{max}$ 334] | 95.2 mg (91.6%) |

Resin Adsorption

Figure 11:
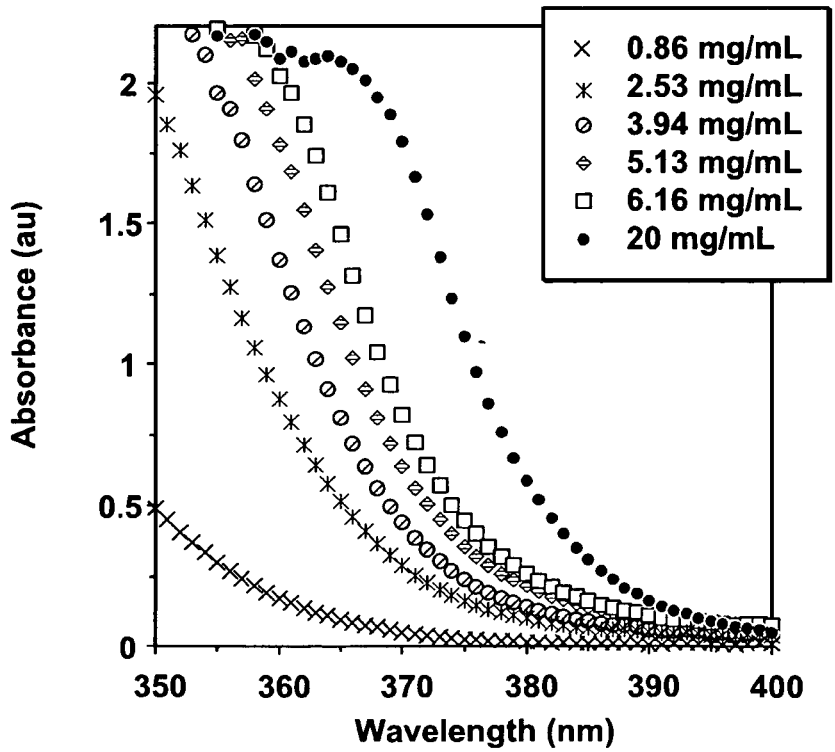
FIG. 11 shows electronic absorption spectra of nitroguanidine in DMSO. Concentrations of nitroguanidine as indicated. The concentrations were corrected for the measured water content in the original sample.

DMSO was used to demonstrate the removal of trace amounts of nitroguanadine by use of reactive resins. Facile dissolution of NQ in DMSO was observed at ambient temperatures. Spectra of the nitroguanadine solutions were taken using pure DMSO as a reference (FIG. 11). As is seen, differential spectra contained a well-defined peak centered at 364 nm that exhibited sharp concentration dependence. Although $\eta$ to $\pi^*$ electronic transitions pertaining to $NO_2$ group as a chromophore are typically observed around 271 nm, according to Woodward's rules, a shift of 95 nm because of the conjugation with an amine —$NR_2$ group is not unusual. This, plus a positive shift due to the polar solvent (DMSO), will yield a peak at around ca. 370 nm, which was actually observed in the experiments.

Taking an absorbance reading at 367 nm as calibration reference, calibration curves were developed in the range of validity of the Lambert-Beer law ($A_{367}$=0-1) (FIG. 11). Square Pearson's correlation coefficients ($R^2$) exceeded 0.99 in all cases.

Figure 12:
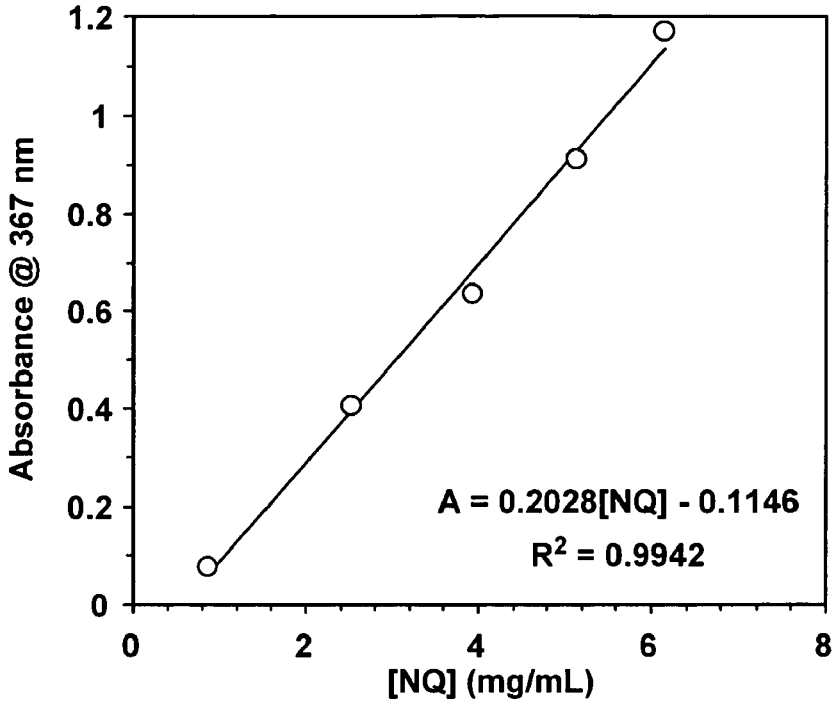
FIG. 12 shows a representative calibration curve developed using electronic absorption at 367 nm in the nitroguanidine solutions in DMSO.
Figure 13:
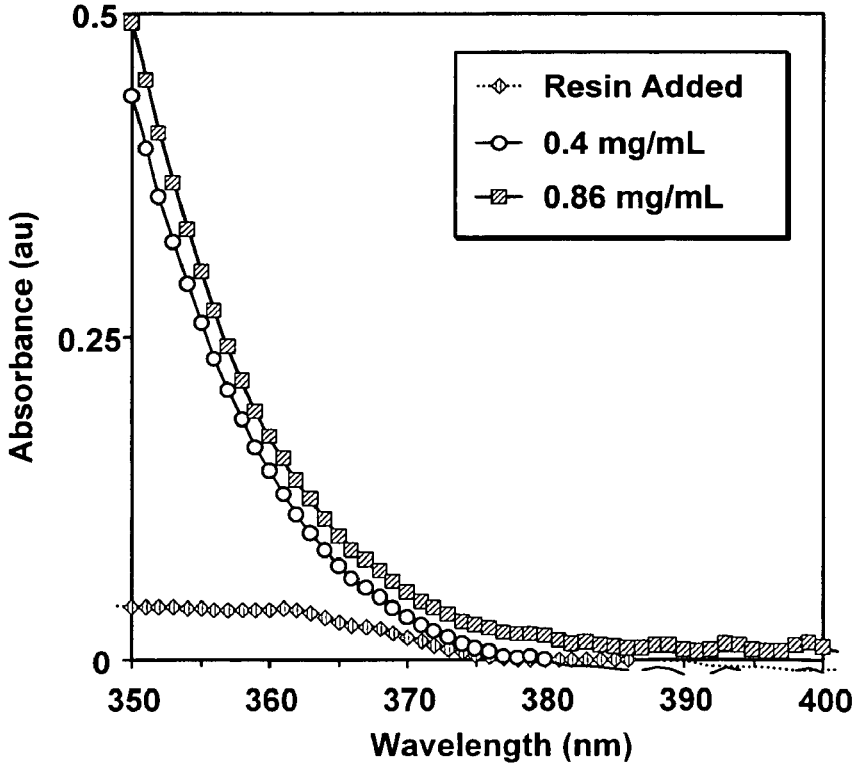
FIG. 13 shows the effect of addition of the PL-CHO resin (CHO content, 0.06 mmol) on the nitroguanidine concentration of DMSO (initial nitroguanidine concentration, 0.045 mmol). Final nitroguanidine concentration below the detection limit (<0.005 mmol).

When an appropriate amount of the CHO-activated resin was placed in the DMSO solutions of nitroguanidine, a yellowish color rapidly developed on the resin beads, while upon the bead removal, the supernatant solution was colorless and transparent. The UV-Vis spectra demonstrated complete removal of the nitroguanidine from the DMSO solutions when the equivalent ratio of the aldehyde groups on the resin to the nitroguanidine was 1.0 or higher (FIG. 12). The results of several separation experiments are presented in Table 6. As is seen, the removal of the nitroguanidine was quantitative when the CHO:NQ molar ratio was above 1.0, with the stoichiometry of the nitroguanidine to the nominal aldehyde (CHO) content close to 1.0 in all cases.

TABLE 6

Results of NQ Removal by Selective Reaction with Aldehyde-Activated Resins

| Initial CHO/ | % Removal (Residual NQ, meq/mL) | |
|---|---|---|
| nitroguanidine | PL-CHO | PL-ICHO |
| 1.9 | 100% (<0.005) | 100% (<0.005) |
| 1.3 | 100% (<0.005) | 100% (<0.005) |
| 0.9 | 90% (0.045) | 90% (0.045) |
| 0.5 | 49% (3.0) | 50% (3.1) |

These results unequivocally demonstrate the reactive extraction of nitroguanidine from its solutions by the activated resins.

M30A1 Processing

Ground M30A1 propellant was obtained from a United States Army stockpile and was processed as described above. The first step of the process was the extraction of nitroguanidine through dissolution in acetone. Dissolution studies were conducted through suspension of 1%, 5%, and 10% [w/v] M30A1 in acetone. Each sample was stirred overnight and subsequently vacuum filtered to remove insoluble materials. The remaining solution was then rotor-evaporated, thus resulting in a dry film. Results of these studies are presented in Table 9.

Based on the data presented in Table 9, while all concentrations provided high yields, concentrations of about 1% or lower [w/v] for the M30A1 in acetone seemed to provide the best results. The more concentrated samples resulted in lower yields, although still high yields. It is also noted that the extraction and the slurry is rather thick at the 10% level.

If desired, further refinement of the nitroguanidine product, thereby removing the inorganic salts, is possible through acid rinsing.

The remaining constituents of the M30A1 propellant were further processed for the removal of nitrocellulose. The isolated material from the 1% study was re-dissolved in acetone, resulting in an approximate 5% [w/v] solution. 100 μL of 1,6-diisocyanatohexane was added to the solution in the presence of 25 μL dibutyltin dilaurate. The reaction was permitted to proceed for one hour, after which time a viscous gel had formed. The process yielded (upon drying) 262 mg of cross-linked nitrocellulose gel and 237 mg of residuals, which contained excess isocyanate, uncross-linked nitrocellulose, and nitroglycerine.

Based on the composition specifications for M30A1, it is assumed that 56% of the dried film product (total weight=466 mg) is nitrocellulose (molecular weight ~278 g/cc). Therefore, a 100% yield would result in 294 mg of cross-linked nitrocellulose (molecular weight ~316 g/cc). The preliminary process resulted in the isolation 262 mg of cross-linked nitrocellulose, thus corresponding to an 89% yield.

The product of such propellant processing represents a urethane resulting from the reaction of OH groups of nitrocellulose (NC) with 1,6-diisocyanatohexane:

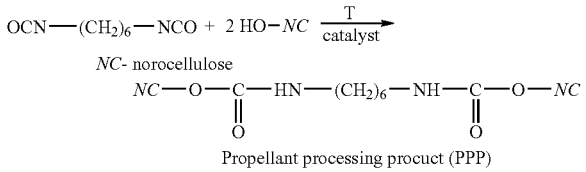

Figure 14:
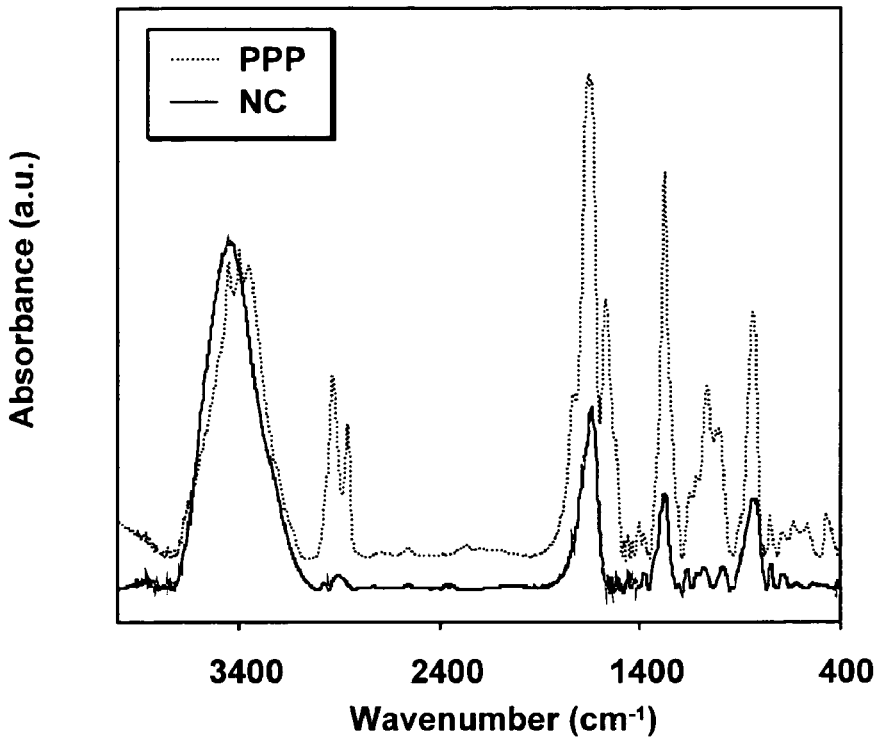
FIG. 14 FTIR spectra of unmodified nitrocellulose (NC) and of the Propellant Processing Product (PPP).

Schematic of a Condensation Reaction Between 1,6-diisocyanatohexane and Hydroxyls of Recovered Nitrocellulose The propellant processing was analyzed by FTIR spectroscopy performed using KBr tablets. As is seen in FIG. 14, the propellant processing exhibited several clearly distinguishable bands in the wavelengths areas of 1500-1600 and 2700-3000 $cm^{-1}$, uncharacteristic of nitrocellulose.

Figure 15:
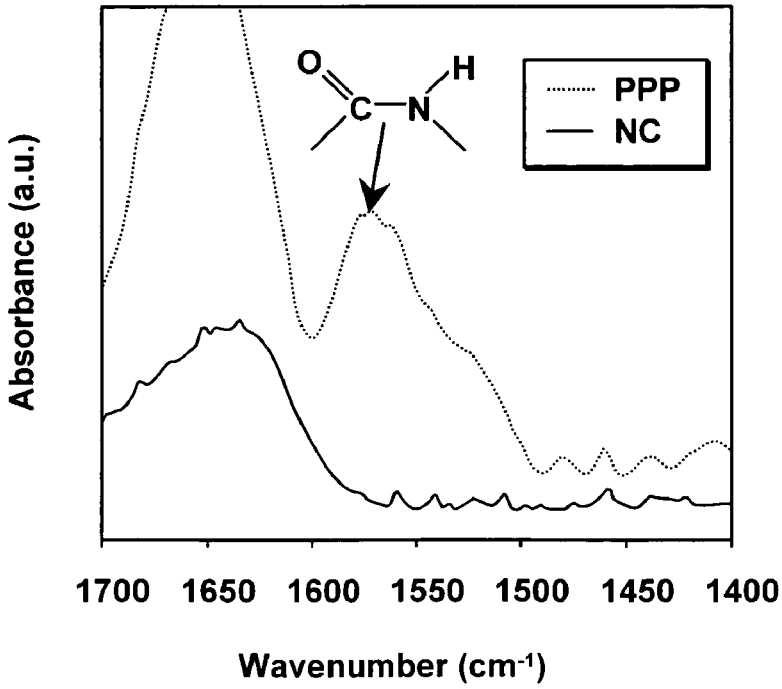
FIG. 15 shows FTIR spectra of unmodified nitrocellulose (NC) and of the Propellant Processing Product (PPP) showing amide stretch band.
Figure 16:
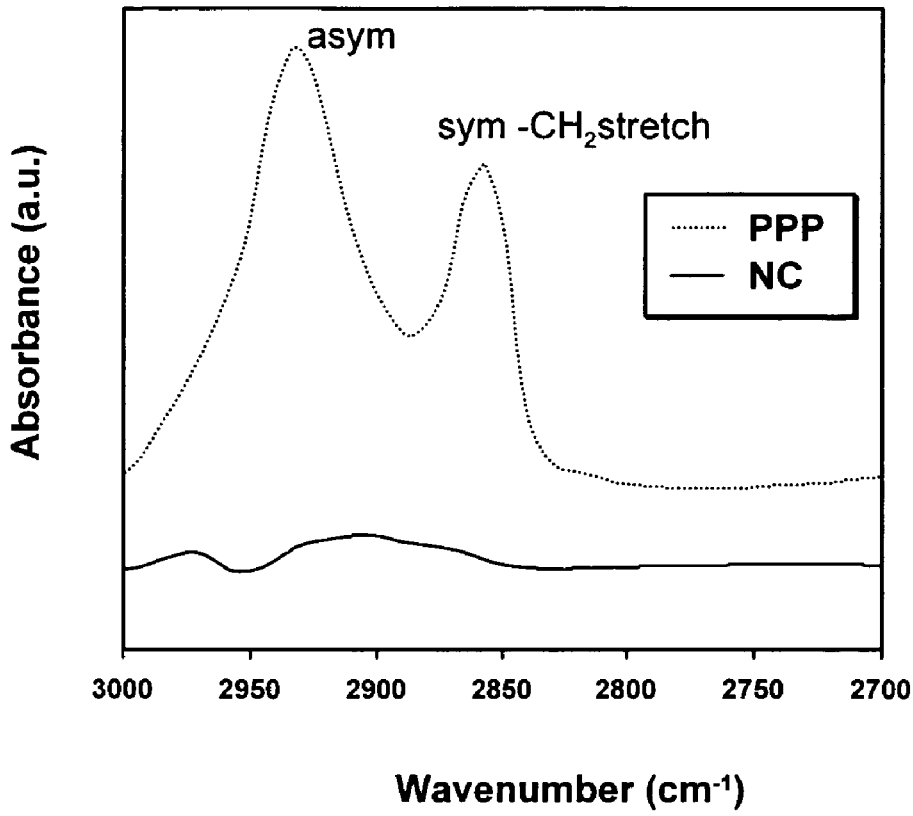
FIG. 16 shows FTIR spectra of unmodified nitrocellulose (NC) and of the Propellant Processing Product (PPP) showing asymmetrical and symmetrical —CH2 stretch band.

As is shown in FIGS. 15 and 16, the band centered at 1570 $cm^{-1}$ is assigned to the stretch of O═C—NH group, while two bans centered at 2930 and 2860 $cm^{-1}$ are assigned to the asymmetrical and symmetrical stretch of the —$CH_2$ groups

TABLE 9

Dissolution of M30A1 in acetone

| Flashless Powder | Aacetone Insoluble* mg [% of expected***] | Acetone Soluble** mg [% of expected****] | Total Recovery |
|---|---|---|---|
| 1% in Acetone | 457 mg [~95%] | 466 mg [~93%] | 92.30% |
| 5% in Acetone | 421 mg [~90%] | 428 mg [~86%] | 84.90% |
| 10% in Acetone | 347 mg [~74%] | 563 mg [~112%] | 91% |

*Assumed to be Nitroguanidine and Inorganic Salts
**Assumed to be Nitrocellulose and Nitroglycerine
***Assuming 47% nitroguanidine in the Flashless Powder
****Assuming 50% Nitrocellulose and Nitroglycerine belonging to the isocyanatohexane part of the propellant processing. These results unequivocally demonstrate the cross-linking reaction between isocyanate and NC recovered from the propellant.

All documents mentioned herein are incorporated by reference herein in their entirety.

The foregoing description of the invention is merely illustrative thereof, and it is understood that variations and modifications can be effected without departing from the scope or spirit of the invention as set forth in the following claims.

What is claimed is:

1. A method for recovering components of a gun propellant formulation comprising nitroguanidine, nitrocellulose and nitro glycerine, the method comprising:

adding a solvent to the formulation to solubilize the gun propellant formulation, wherein the nitroguanadine is insoluble in the solvent;

separating the insoluble nitroguanidine out of the solubilized gun propellant formulation;

adding at least one crosslinker to the formulation, wherein the crosslinker preferentially reacts with the nitrocellulose; and removing the cross-linked nitrocellulose from the solubilized gun propellant formulation, wherein the cross-linker is added to a solubilized gun propellant formulation that has been dried to remove water.

2. The method of claim 1, wherein nitrocellulose is separated as a cross-linked nitrocellulose.

3. The method of claim 1, wherein the cross-linker is a multifunctional isocyanate.

4. The method of claim 3, wherein the multifunctional isocyanate is selected from diisocyanates, polyisocyanates and mixtures thereof.

5. The method of claim 3, wherein the multifunctional isocyanate is selected from aliphatic, cycloaliphatic, araliphatic, aromatic and heterocyclic polyisocyanates.

6. The method of claim 3, wherein the multifunctional isocyanate is selected from hexamethylediisocyanate, tetramethylxylylene diisocyanate, 4-methyl-1,3-phenylene diisocyanate, TDI and its dimmers, 1,6-hexamethylene diisocyanate and its oligomers, 1-isocyanato-3-isocyanatomethyl-3,5,5-trimethyl-cyclohexane, 4,4'-diisocyanato dicyclohexylmethane and its oligomers, 1,5-diisocyanato-2-methylpentane and its oligomers, 1,12-diisocyanatododecane and its oligomers, 1,4-diisocyanatobutane and its oligomers, isophorone diisocyanate (IPDI), 1,4-cyclohexane diisocyanate, 1-methyl-2,4-cyclohexane diisocyanate, 4,4'-, 2,2'- and 2,4'-diphenylmethane diisocyanate, mixtures of 2,4- and 4,4'-diphenylmethane diisocyanate, urethane-modified, liquid 2,4- and/or 4,4'-diphenylmethane diisocyanates, 4,4'-diisocyanato-1,2-diphenylethane and 1,5-naphthylene diisocyanate, 1-methyl-2,6-cyclohexane diisocyanate and isomer mixtures thereof, 4,4'-, 2,4'- and 2,2'-dicyclohexylmethane diisocyanate and isomer mixtures thereof.

7. The method of claim 1, wherein the crosslinker is 1,6-diisocyanatohexane.

8. The method of claim 1, wherein the crosslinker is selected so as to yield a specific crosslinked nitrocellulose product.

9. The method of claim 1, wherein the crosslinker is added in the presence of a catalyst.

10. The method of claim 9, wherein the catalyst is an organic or organometallic catalyst, capable of catalyzing a crosslinking reaction.

11. The method of claim 9, wherein the catalyst is an organic metal compound.

12. The method of claim 11, wherein the organic metal compound is selected from titanic acid esters, iron compounds and tin compounds.

13. The method of claim 11, wherein the organic metal compound is selected from tin diacetate, tin dioctoate and tin dilaurate.

14. The method of claim 9, wherein the catalyst is a dialkyltin salt of aliphatic carboxylic acids.

15. The method of claim 9, wherein the catalyst is selected from dibutyltin diacetate, dibutyltin dilaurate or the like.

16. The method of claim 15, wherein the catalyst is dibutyltin dilaurate.

17. The method of claim 1, wherein the nitrocellulose is separated by adding a crosslinker to the formulation, allowing the crosslinker to crosslink with the nitrocellulose in the formulation, allowing a viscous gel to form, and drying the viscous gel to yield cross-linked nitrocellulose network.

18. The method of claim 1, wherein at least one of the components separated out is a polyurethane product.

19. The method of claim 18, wherein the polyurethane product is in the form of a powder, paste, viscous or elastic solution, or gel.

20. The method of claim 1, wherein nitrocellulose is separated from the formulation as a precursor for coating compositions.

21. The method of claim 1, wherein a non-hazardous solvent is used to selectively separate nitroguanadine from the formulation.

22. The method of claim 21, wherein the solvent is selected from solvents that do not react with crosslinker(s) used in the method.

23. The method of claim 21, wherein the solvent is an organic solvent.

24. The method of claim 23, wherein the solvent is selected from ethers, alcohols, ketones, nitrites, nitro compounds, unsubstituted or substituted aliphatic or aromatic hydrocarbons, and mixtures thereof.

25. The method of claim 21, wherein the solvent is selected from acetone, methyl ethyl ketone, methyl isobutyl ketone, ethyl acetate, n-butyl acetate, and cyclohexanone.

26. The method of claim 25, wherein the solvent is acetone.

27. The method of claim 21, further comprising, after separating nitroguanidine from the formulation, further separating remaining amounts of nitroguanidine remaining in the formulation.

28. The method of claim 27, wherein remaining amounts of nitroguanidine remaining in the formulation are separated using a non-hazardous solvent.

29. The method of claim 1, wherein nitroglycerine is separated from the formulation by using a solvent.

30. The method of claim 29, wherein the solvent is selected from acetone, methyl ethyl ketone, methyl isobutyl ketone, cyclohexanone, dimethylformamide, dimethylacetamide, tetrahydrofuran and mixtures thereof.

31. The method of claim 30, wherein the solvent is acetone.

32. The method of claim 1, wherein nitroglycerine is separated out of the formulation in a form usable in pharmaceutical compositions.

33. The method of claim 1, wherein the step of separating out nitroguanidine, nitrocellulose and nitroglycerine from the formulation comprises utilizing one or more crosslinkers and/or one or more non-hazardous solvents.

34. The method of claim 1, wherein the step of separating out nitroguanidine, nitrocellulose and nitroglycerine from the formulation comprises adding crosslinkers and/or non-hazardous solvents to the gun propellant formulations.

35. The method of claim 1, wherein at least about 90% of the nitrocellulose present in the formulation is separated out of the formulation.

36. The method of claim 1, wherein at least about 95% of the nitrocellulose present in the formulation is separated out of the formulation.

37. The method of claim 1, wherein at least about 98% of the nitrocellulose present in the formulation is separated out of the formulation.

38. The method of claim 1, wherein at least about 99% of the nitrocellulose present in the formulation is separated out of the formulation.

39. The method of claim 1, wherein the step of separating out nitroguanidine, nitrocellulose and nitroglycerine from the formulation comprises:

solubilizing the gun propellant formulation in a solution of recyclable organic solvent;

separating the insoluble nitroguanidine to yield a mixture of nitrocellulose and nitroglycerine;

reacting the nitrocellulose with a cross-linker to yield an insoluble nitrocellulose; and separating the nitroglycerine from the cross-linked nitrocellulose.

40. A method for recovering components of a gun propellant formulation comprising:

adding a solvent to the gun propellant formulation to solubilize the gun propellant formulation, the gun propellant formulation comprising nitroguanadine, nitrocellulose and nitroglycerine, wherein the nitroguanadine is insoluble in the solvent;

separating the insoluble nitroguanidine out of the solubilized gun propellant formulation;

adding at least one cross-linker to the solubilized gun propellant formulation wherein the crosslinker preferentially reacts with the nitrocellulose resulting in precipitation of cross-linked nitrocellulose; and separating the cross-linked nitrocellulose from the solubilized gun propellant formulation, the solubilized gun propellant formulation containing at least about 50% of the nitroglycerine from the gun propellant formulation.

41. The method of claim 1 wherein nitroguanidine is separated from the formulation first, followed by the nitrocellulose, and nitroglycerine remaining in the formulation is then purified.

42. The method of claim 40, wherein the solubilized gun propellant formulation contains at least about 60% of the nitroglycerine from the gun propellant formulation.

43. The method of claim 40, wherein the solubilized gun propellant formulation contains at least about 70% of the nitroglycerine from the gun propellant formulation.

44. The method of claim 40, wherein the solubilized gun propellant formulation contains at least about 80% of the nitroglycerine from the gun propellant formulation.

45. A method for recovering components of a gun propellant formulation, comprising:

adding a solvent to the gun propellant formulation to solubilize the gun propellant formulation, the gun propellant formulation comprising nitroguanadine, nitrocellulose and nitroglycerine, wherein the nitroguanadine is insoluble in the solvent;

separating the insoluble nitroguanidine out of the solubilized gun propellant formulation;

adding at least one crosslinker to the solubilized gun propellant formulation, wherein the crosslinker preferentially reacts with the nitrocellulose to form a solubilized gun propellant formulation with solubilized nitroglycerine and cross-linked nitrocellulose;

separating the cross-linked nitrocellulose out of the solubilized gun propellant formulation; and separating the nitroglycerine out of the solubilized gun propellant formulation by extraction.

* * * * *